US005829756A

United States Patent [19]

Mitchell et al.

[11] Patent Number: 5,829,756

[45] Date of Patent: Nov. 3, 1998

[54] APPARATUS FOR SLOWING OR STOPPING A ROLLER SKATE AND METHODS

[75] Inventors: David N. Mitchell, Englewood; Gregory C. Sturgeon, Brighton, both of Colo.

[73] Assignee: Out of Line Sports, Inc., Englewood, Colo.

[21] Appl. No.: 924,442

[22] Filed: Aug. 26, 1997

Related U.S. Application Data

[63] Continuation-in-part of Ser. No. 801,858, Feb. 18, 1997.

[51] Int. Cl.[6] ..... A63C 17/14

[52] U.S. Cl. ..... 280/11.2; 188/2 D; 188/29

[58] Field of Search ..... 280/11.2; 188/2 D, 188/4 B, 25, 29, 80

[56] References Cited

U.S. PATENT DOCUMENTS

| | | | |
|---|---|---|---|
| 3,062,328 | 11/1962 | Butler et al. | 188/33 |
| 3,583,052 | 6/1971 | Herbenar et al. | 29/175 |
| 3,933,220 | 1/1976 | Swager | 182/3 |
| 4,033,433 | 7/1977 | Kirk | 188/25 |
| 4,048,938 | 9/1977 | Patterson, III et al. | 114/75 |
| 4,172,676 | 10/1979 | De Chant | 403/43 |
| 4,852,697 | 8/1989 | Kulik | 188/2 |
| 5,193,827 | 3/1993 | Olson | 280/7.13 |
| 5,397,137 | 3/1995 | Pellegrini, Jr. et al. | 280/11.2 |
| 5,435,579 | 7/1995 | Pozzobon | 280/11.2 |
| 5,462,296 | 10/1995 | Pozzobom | 280/11.2 |
| 5,511,804 | 4/1996 | Pellegrini, Jr. et al. | 280/11.2 |
| 5,570,759 | 11/1996 | Zorzi | 188/5 |
| 5,685,550 | 11/1997 | Mayer, II | 280/11.2 |
| 5,755,449 | 5/1998 | Pozzobon | 280/11.2 |

*Primary Examiner*—D. Glenn Dayoan
*Assistant Examiner*—Clovia Hamilton
*Attorney, Agent, or Firm*—Townsend and Townsend and Crew

[57] ABSTRACT

The invention provides a braking systems and methods for slowing or stopping a roller skate having a plurality of wheels. In one exemplary system, at least one braking surface is spaced apart from the wheels. A means is provided between the braking surface and at least one of the wheels for slowing or stopping the wheel such that heat generated when slowing or stopping the wheel is created at the braking surface and is substantially prevented from reaching the wheel.

29 Claims, 20 Drawing Sheets

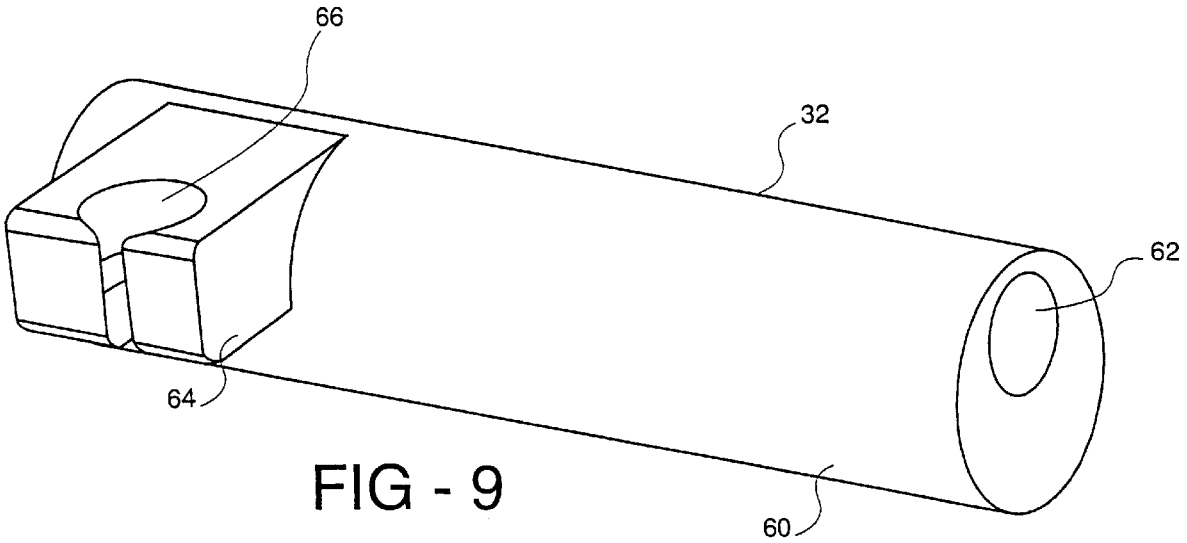
FIG - 9
FIG - 9B
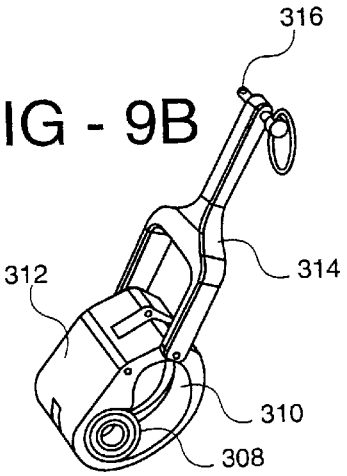
FIG - 9A
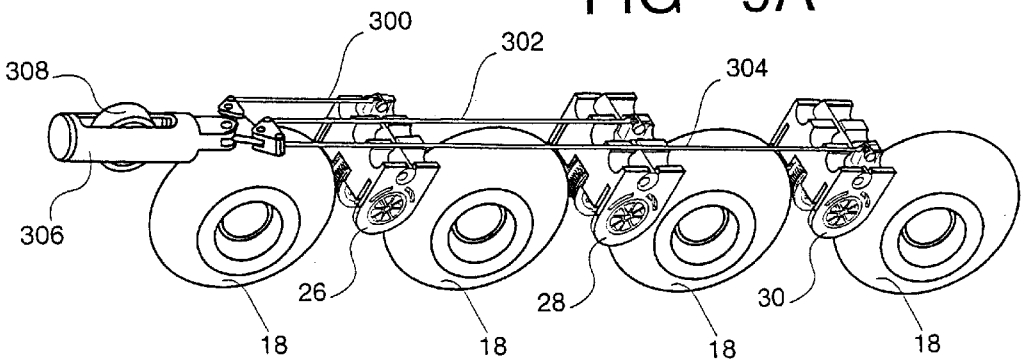

FIG - 20B
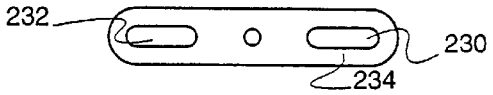
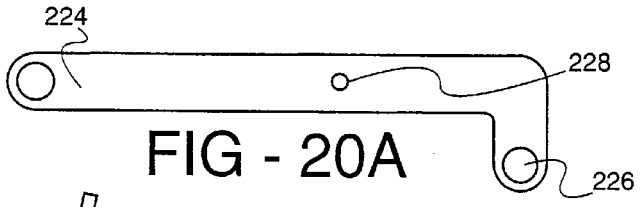
FIG - 20A
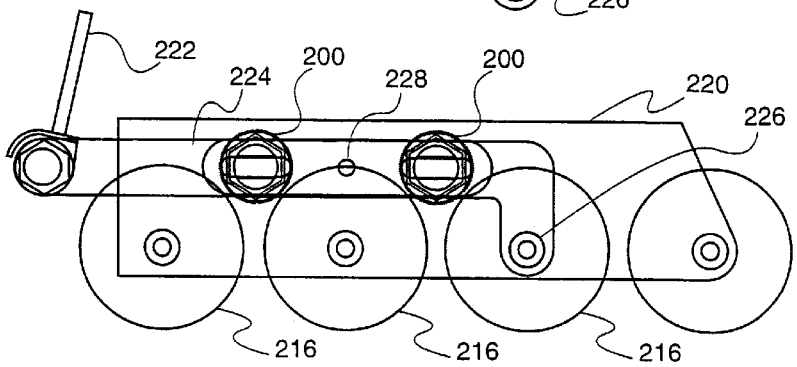
FIG - 20
FIG - 21C
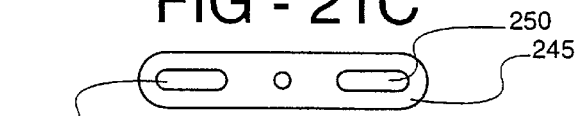
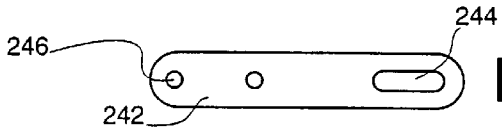
FIG - 21B
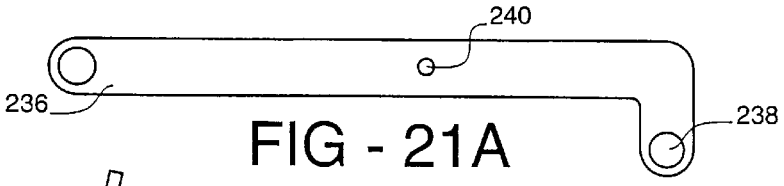
FIG - 21A
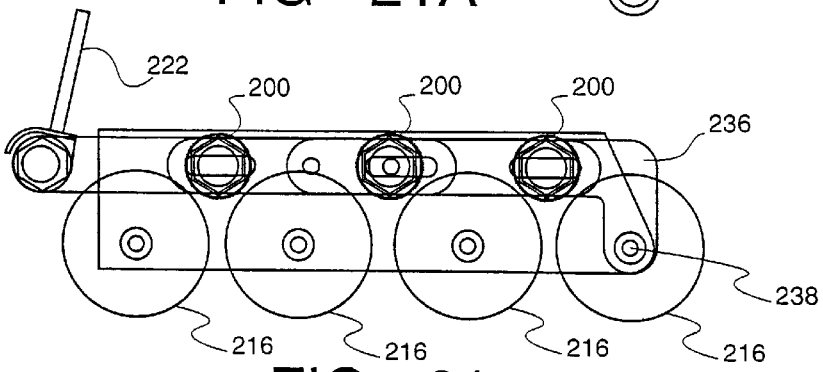
FIG - 21

FIG - 22B
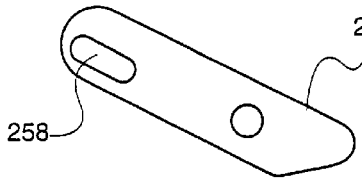
FIG - 22A
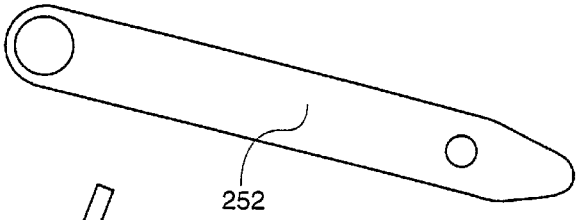
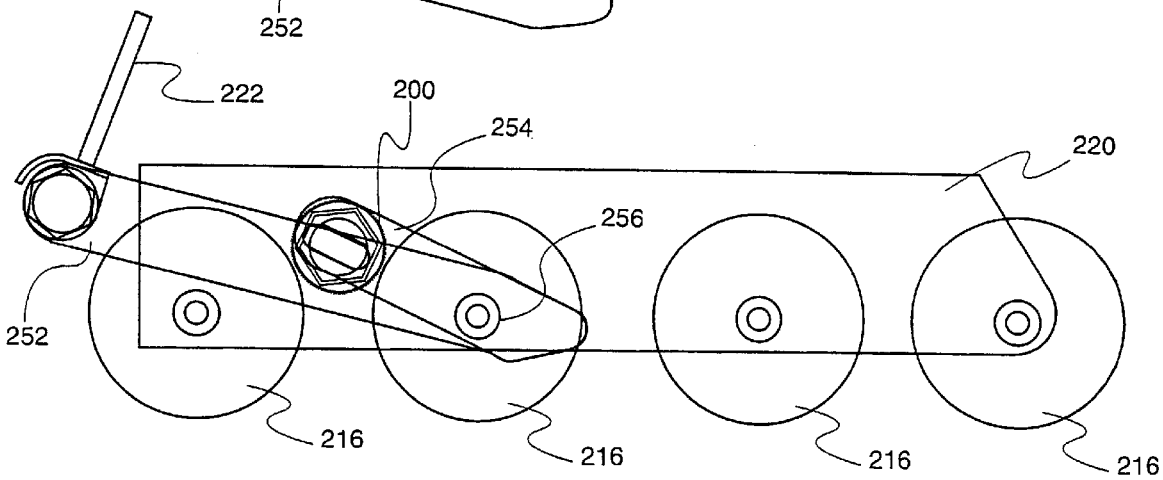
FIG - 22
FIG - 22C
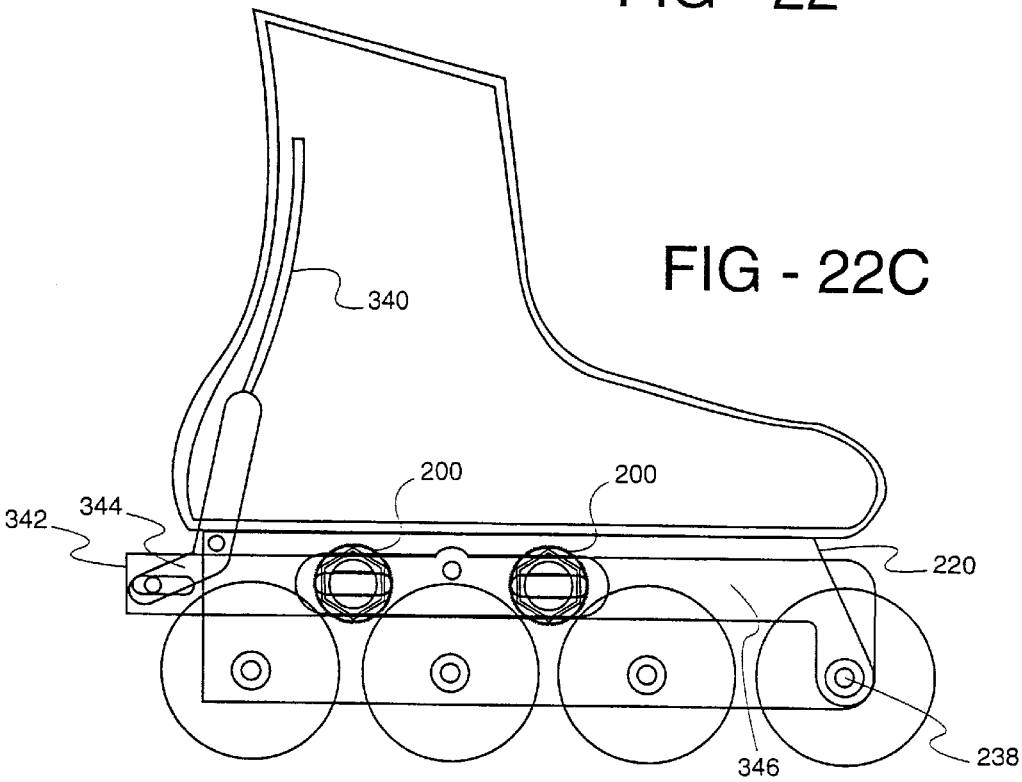

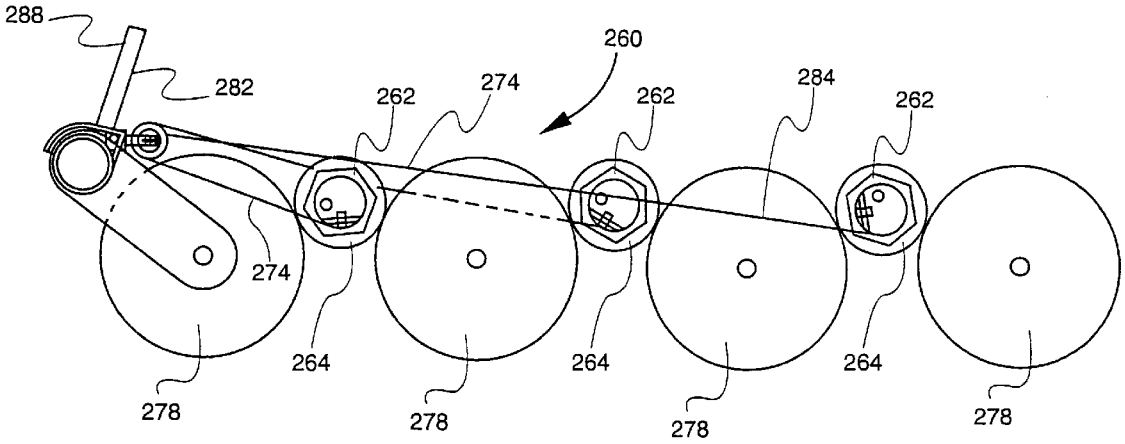
FIG - 23
FIG - 24
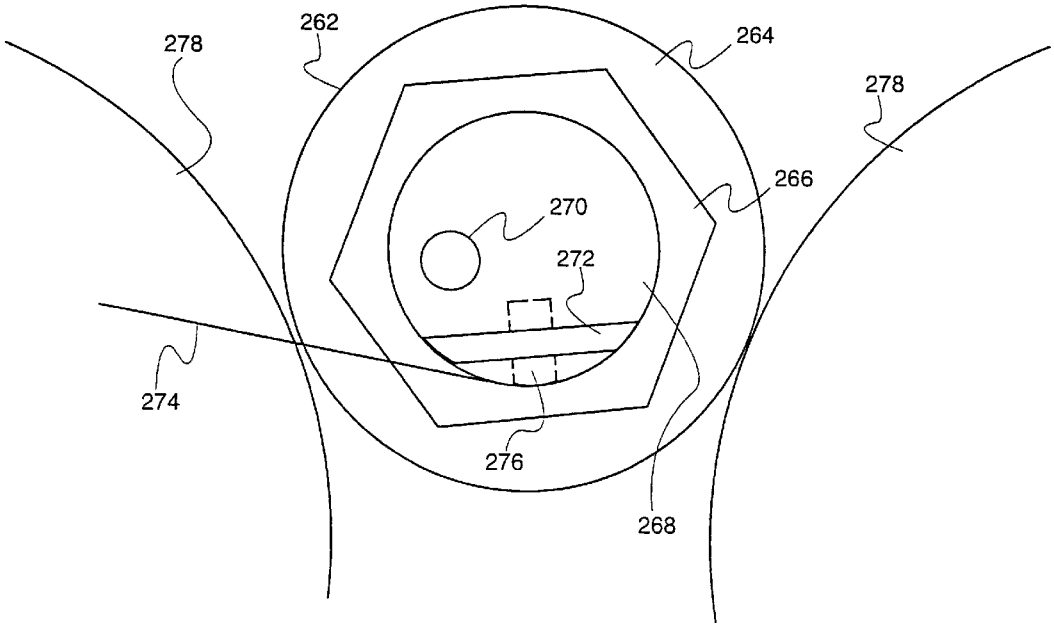

FIG - 27
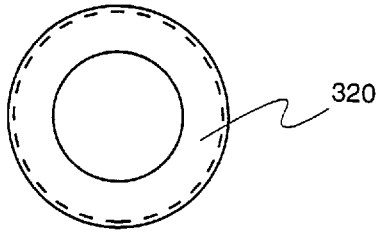
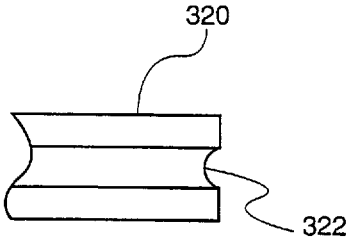
FIG - 28A
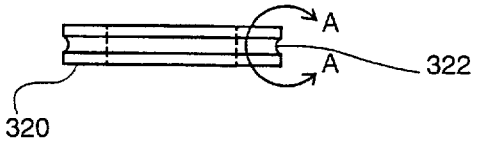
FIG - 28
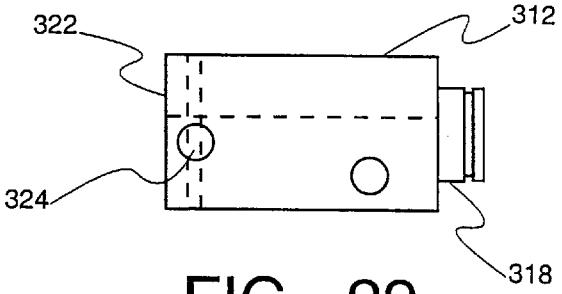
FIG - 29
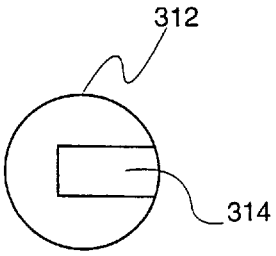
FIG - 31
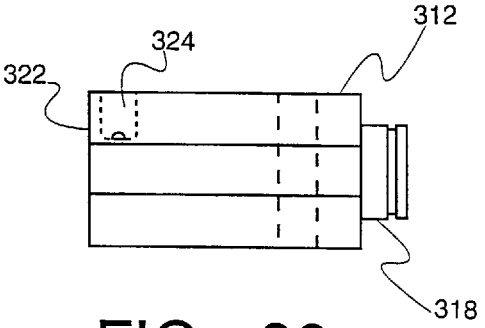
FIG - 30

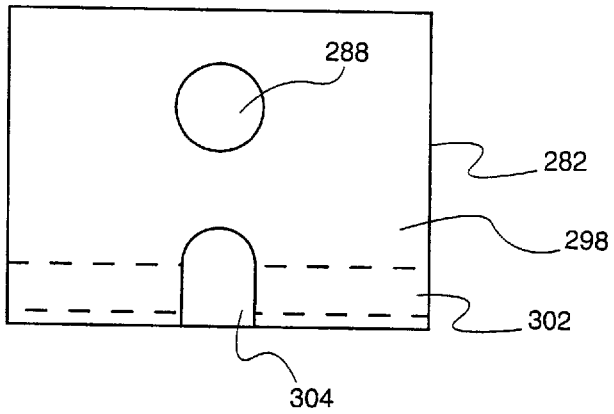
FIG - 32
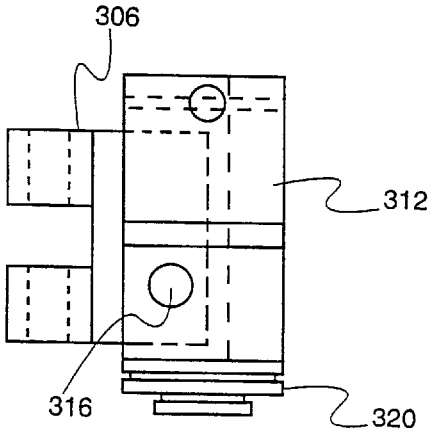
FIG - 35
FIG - 33
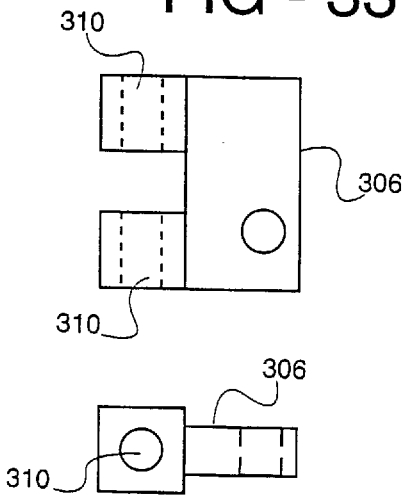
FIG - 34

FIG - 37
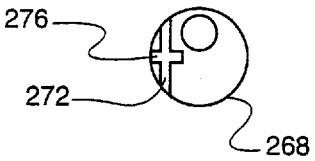
FIG - 36
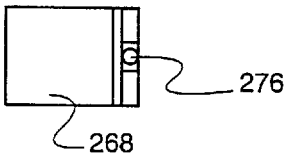
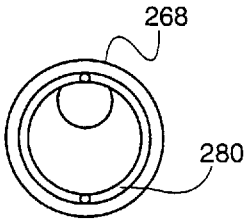
FIG - 39
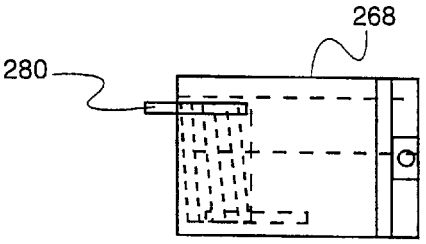
FIG - 38

APPARATUS FOR SLOWING OR STOPPING A ROLLER SKATE AND METHODS

CROSS REFERENCE TO RELATED APPLICATION

This application is a continuation in part application of U.S. patent application Ser. No. 08/801,858, filed Feb. 18, 1997, and also claims benefit from U.S. Provisional patent application Ser. No. 60/053414, filed Jul. 22, 1997 (Attorney docket no. 17251-000920), the complete disclosures of all these applications are incorporated by reference.

BACKGROUND OF THE INVENTION

This invention relates generally to the field of roller skates. More particularly, this invention relates to a roller skate brake which slows or stops the skate by engaging at least one of the wheels while preventing heat energy that is created from slowing the wheel from transferring to the wheel.

Traditional roller skates, having set the wheels in tandem, have long been used in the relatively controlled environment of a skating rink. In a skating rink, the skating surface is typically flat and smooth, and skaters travel in the same direction around an oval or circular track. Hence, there are few unexpected hazards. Therefore, there has been little need for an effective brake on the traditional roller skate.

Recently, however, a faster and more maneuverable type of roller skate has been introduced. Such skates, known as "in-line" skates with wheels mounted in line rather than in tandem can function similar to an ice skate. In-line skates are offered in the United States by several vendors, including Rollerblade, Variflex, Bauer, and Ultra Wheels. In-line skates appeal to the athletic old and young adults and hence persons who enjoy the outdoors. Such skates are commonly used outside, on uneven sidewalks, bicycle paths, and roads. One appealing feature of the in-line skates is the high speed that can be achieved. However, this may become hazardous to the skater and others when skating more rapidly than conditions allow. Hence, a variety of brakes for in-line skates have been proposed.

One proposed brake for in-line skates involves a thick friction pad that extends behind the heel of the skate. The thick friction pad is disposed above the skating surface and is made to swing down towards the skating surface by the skater's pivoting the skate about the axis of the rear wheel. As the skater raises the toe of the skate and rotates the heel downward, the friction pad behind the heel will contact the ground and stop the skate. Brake systems have also been used on tandem wheel skates which may also include (because the speeds are not so high with tandem wheel skates) a fixed friction pad that extends in front of the toe of the skate. In this case, the skater brings the friction pad to bear on the skating surface by raising the heel and lowering the toe. Such brake systems require either the toe to be raised or lowered suffer from a number of serious drawbacks including skater fatigue in operating the brake and difficulty in maneuvering the skate to engage the brake with the skating surface.

One particularly useful type of brake which does not require the toe to be raised or lowered is a mechanically activated brake which engages the ground to slow or stop the brake as described in U.S. Pat. Nos. 5,211,409; 5,253,882; 5,316,325; 5,330,207; 5,564,718, the complete disclosures of which are incorporated herein by reference. Such a brake system includes a carriage that pivots about the rear of the skate so as to bring the brake pad into contact with the skating surface when activated by an actuator which does not require either the heel or the toe to be lowered.

Another useful type of braking system is described in U.S. Pat. Nos. 5,649,715 and 5,651,556, the disclosures of which are herein incorporated by reference. This braking system employs a sliding brake which slides relative to the skate frame to bring a braking pad into ground engagement.

Although some of such braking systems which engage a braking pad with a skating surface have proven to be generally successful in slowing or stopping the roller skates, it would be desirable to provide a braking system for a roller skate where ground engagement is not needed. In this manner, the need to place a pad on the ground to slow or stop a skate will be eliminated. This in turn, will provide improved control since the skater will not have a braking pad engaging the ground while slowing or stopping the skate. Further, it will eliminate the interference of the brake with the toe of the other foot when performing crossovers. Moreover, elimination of a bulky braking pad will make the skate more aesthetically pleasing. Some previously proposed braking systems have employed a brake pad which directly engages the wheel to slow or stop the skate. However, such a configuration is undesirable in that heat is created directly on the wheel's surface when the braking pad engages the wheel. Such heat may cause the wheels to melt, particularly since many wheels are now commonly constructed of urethane. Another problem is that such direct engagement may cause excessive wear to occur on the wheel surface.

Hence, for these and other reasons, it would be desirable to provide a skate braking system which will slow or stop a skater without engaging a brake pad with the ground and without excessively heating the wheels of the skate. Among other advantages, such braking system should be relatively easy to use and should not be bulky so as to interfere with the skater's movements.

SUMMARY OF THE INVENTION

The invention provides braking systems and methods for slowing or stopping a roller skate. In one exemplary braking system, at least one braking surface is spaced apart from a plurality of wheels. A means is provided between the braking surface and at least one of the wheels of slowing or stopping the wheel, such that heat generated when slowing or stopping the wheel is created at the braking surface and is substantially prevented from reaching the wheel.

The braking system will be particularly useful when the wheels of the roller skate are in line with each other. When the wheels are in line with each other, the means for slowing or stopping is preferably positioned between two of the in line wheels so that one or more of the wheels may be slowed or stopped at substantially the same time. In one particularly preferred embodiment, the means of slowing or stopping comprises a rotatable member which may be positioned to contact one of the wheels when rotating. When the rotatable member is positioned against the wheel, the rotatable member will freely rotate. A portion of the rotatable member is then engaged with the braking surface to gently slow rotation of the rotatable members. Since the rotatable member is in contact with the wheel, as the rotatable member is slowed by the braking surface, the wheel will also slow. Preferably, the rotatable member will be engaged with the wheel such that no slippage will occur between the wheel and the rotatable member. In this way, little or no heat will be generated at the interface between the wheel and the rotatable member. Hence, with such a configuration, rotation of the wheel will be gently slowed while the heat generated between the braking surface and the rotatable member will be away from the wheel so as to not damage the wheel. Further, since the rotatable member is spaced apart from the wheels until actuated, no additional friction is applied to the wheels when actively skating or gliding. In this way, the wheels may efficiently turn until the brake is applied.

In another aspect of the system, an actuator is provided which positions the rotatable member against the wheel and also engages the braking surface with the rotatable member. One particularly preferable actuator comprises a cam or a pivotable brake arm which moves the rotatable member into contact with the wheel upon rotation of the cam or pivoting of the brake arm. A variety of mechanisms can be employed to rotate the cam or pivot the brake arm including a cable, a rod, an air cylinder, a hydraulic cylinder, a lever, and the like. Such mechanisms may in turn be connected to the cuff of the boot or to an elongate member (such as shown in FIG. 33, patent application Ser. No. 08/664,068, filed Jun. 13, 1996, the disclosure of which is herein incorporated by reference), so that movement of the skater's leg may rotate the cam or pivot the brake arm.

In one particular embodiment, the invention provides a braking unit which slows or stops the wheels by direct engagement with at least one wheel without creating substantial heating of the wheel. The braking unit comprises a friction hub, an elastomeric or rubber pad having an inner core or surface, and a wheel engaging hub which are assembled together. When the braking unit is engaged between a pair of wheels by a force, the wheel engaging hub is compelled to rotate by the turning wheel of the skate, similar to the engagement of gears with one another. As the wheel engaging hub rotates, the rubber pad is rotated at the same rate by virtue of it's engagement within the wheel engaging hub (engagement of the rubber pad may be facilitated by virtue of a hexagonal cross-section of the rubber pad and a mating hexagonal bore within the wheel engaging hub). Braking results when the inner bore of the rubber pad rotates around the friction hub. The friction hub, which is constrained not to rotate, provides a friction surface for the rubber pad. The surface texture of the friction hub, combined with the compound type and hardness of the rubber pad, serve to resist the turning motion of the skate wheels. This resistive torque is transmitted through the wheel engaging hub and to the turning wheels, slowing the skate to which the wheels are attached.

Cooling may take place in any number of ways, including convection, conduction, and radiation. Specific examples include convectively cooling the wheel engaging hub and friction hub by increased surface area, such as might be achieved by way of a multitude of holes through the friction hub and wheel engaging hub. They may also be cooled by a turbine fan, or by a liquid contained within the friction and wheel engaging hubs. Radiant cooling could be enhanced by way of a dark surface finish of the brake components. Conductive cooling might be achieved through some form of intimate contact between a skate component such as a metallic wheel rack and one or more metallic braking components. Optionally, a piece of insulation may be placed between the wheel engaging hub and the elastomeric pad.

A variety of activation methods may be employed to activate the brake unit. For example, a cuff or an elongated member as shown in FIG. 33 of U.S. patent application Ser. No. 08/664,068 may be employed to activate either a rod, a lever, a cable or the like. Such mechanisms may be used to activate one or more engaging hubs to stop one or more wheels. The amount of braking produced may be varied by providing additional braking units, altering the friction surface of the friction hub, and altering the durometer of the elastomeric member.

Another method of activation is by using a cuff or elongated member to activate an eccentric pivot in the braking unit via a cable, a lever, a rod or the like. This method can be used to activate one or more engaging hubs to stop one or more wheels.

The invention further provides a braking system for roller skates having a plurality of in-line wheels which rotate from the roller skate when rolling over a skating surface. The system comprises a rotatable member which may be positioned to contact at least one of the wheels when rotating. When the rotating member is positioned against the wheels, the rotatable member freely rotates. A braking surface is provided and is engageable with the rotatable member so that as the rotatable member engages the braking surface, the rotatable member will be slowed which in turn gently slows rotation of the in-line wheel.

In a preferable aspect, the rotatable member may be positioned to contact two of the in-line wheels at substantially the same time. In this manner, both of the wheels will be slowed at substantially the same rate thereby preventing one of the wheels from "locking up". In another aspect, at least a portion of the rotatable member is thermally conductive so that heat generated between the rotatable member and the braking surface may be dissipated into the atmosphere before reaching the wheels. An exemplary material for constructing the rotatable member is aluminum. A plurality of heat transfer ribs may also be provided on the rotatable member to assist in dissipating the heat. The rotatable member may also include insulation, such as a ceramic material, for preventing heat generated at the braking surface from transferring to the wheel.

In yet another aspect, an actuator is provided which positions the rotatable member against the wheel and engages the braking surface with the rotatable member. One particularly preferable actuator is a cam which may be rotated within a groove of an elastomeric housing. The braking surface is formed within the housing, and the rotatable member is rotatably attached to the housing so as to be spaced apart from the braking surface. In this way, rotation of the cam forces the braking surface against the rotatable member after the rotatable member has moved into contact with the wheels. Usually, the cam will be rotatably connected to a skate frame.

The invention further provides a roller skate comprising a brake and a frame which connects a plurality of in-line wheels to the boot. A braking surface is operably attached to the frame, and a means is provided between the braking surface and at least one of the wheels for slowing or stopping the wheel. The means for slowing or stopping is configured so that heat generated when slowing or stopping the wheel is created at the braking surface and is substantially prevented from reaching the wheel.

The invention provides an exemplary method for slowing or stopping a moving roller skate. According to the method, a rotating wheel of the roller skate is contacted with a rotatable member. The rotatable member is then slowed such that heat energy created in slowing the rotatable member is substantially prevented from reaching the wheel. The rotatable member is preferably gently slowed so that no jerking action will result when slowing or stopping the wheel.

The rotatable member will preferably be slowed by positioning the braking surface against a rotatable member such that substantially no slippage is created between the wheel and the rotatable member.

In another aspect to the method, the roller skate preferably includes an elastomeric housing having the braking surface formed therein, and the rotatable member being rotatably attached to the housing so as to be spaced apart from the braking surface. In this manner, a rotatable member may be positioned against the braking surface by compressing the housing to force the braking surface against the rotatable member after the rotatable member contacts the wheel. The braking surface will preferably be positioned against the rotatable member by rotating a cam. An exemplary aspect, rotation of the cam will result from rotating a cuff on a roller skate.

BRIEF DESCRIPTION OF THE DRAWINGS

FIG. 9 is a perspective view of a cam actuator of the braking unit of FIG. 4.

FIGS. 9A and 9B are perspective views of an alternative braking system employing a plurality of braking units as illustrated in FIG. 4.

FIG. 20 shows an alternative embodiment of the system of FIG. 19.

FIG. 20A illustrates a brake arm of the system of FIG. 20.

FIG. 20B illustrates a linkage attachable to the brake arm of the system of FIG. 20.

FIG. 21 illustrates a further alternative embodiment of a braking system of FIG. 19.

FIG. 21A illustrates a brake arm of the system of FIG. 21.

FIG. 21B illustrates a first linkage which is attachable to the brake arm of the system of FIG. 21.

FIG. 21C illustrates a second linkage which is attachable to the brake arm of the system of FIG. 21.

FIG. 22 illustrates still a further embodiment of a braking system according to the invention.

FIG. 22A illustrates a first linkage of a brake arm of the braking system of FIG. 22.

FIG. 22B illustrates a second linkage of the brake arm of the braking system of FIG. 22.

FIG. 22C illustrates a braking system employing a paddle to initiate braking action according to the invention.

FIG. 23 illustrates yet another embodiment of a braking system employing an eccentric pivot according to the invention.

FIG. 24 is a more detailed view of a brake unit of the system of FIG. 23.

FIG. 27 is a side view of a spool employed in the braking system of FIG. 23.

FIG. 28 is a top view of the spool of FIG. 27.

FIG. 28A is a more detailed view of the spool of FIG. 28 taken along lines A—A.

FIG. 29 is a top view of a pivot member employed in the braking system of FIG. 23.

FIG. 30 is a side view of the pivot member of FIG. 29.

FIG. 31 is an end view of the pivot member of FIG. 30.

FIG. 32 is a top view of the activation mechanism of FIG. 26.

FIG. 33 is a top view of a link member employed by the braking system of FIG. 23.

FIG. 34 is a side view of the link member of FIG. 33.

FIG. 35 illustrates the link member of FIG. 33 attached to the pivot member of FIG. 29.

FIG. 36 is a side view of a friction hub employed by the braking system of FIG. 23.

FIG. 37 is an end view of the friction hub of FIG. 36.

FIG. 38 illustrates the friction hub of FIG. 36 with a spring loading.

FIG. 39 is an end view of the friction hub of FIG. 38.

DETAILED DESCRIPTION OF THE SPECIFIC EMBODIMENTS

The invention provides braking systems and methods for slowing or stopping a roller skate without engaging a braking pad with the skating surface and without generating a significant amount of heat on the wheels of the skate when the skate is being slowed or stopped. Although the systems and methods may be used with virtually any type of roller skate, they will find their greatest use with in-line roller skates.

Figure 1:
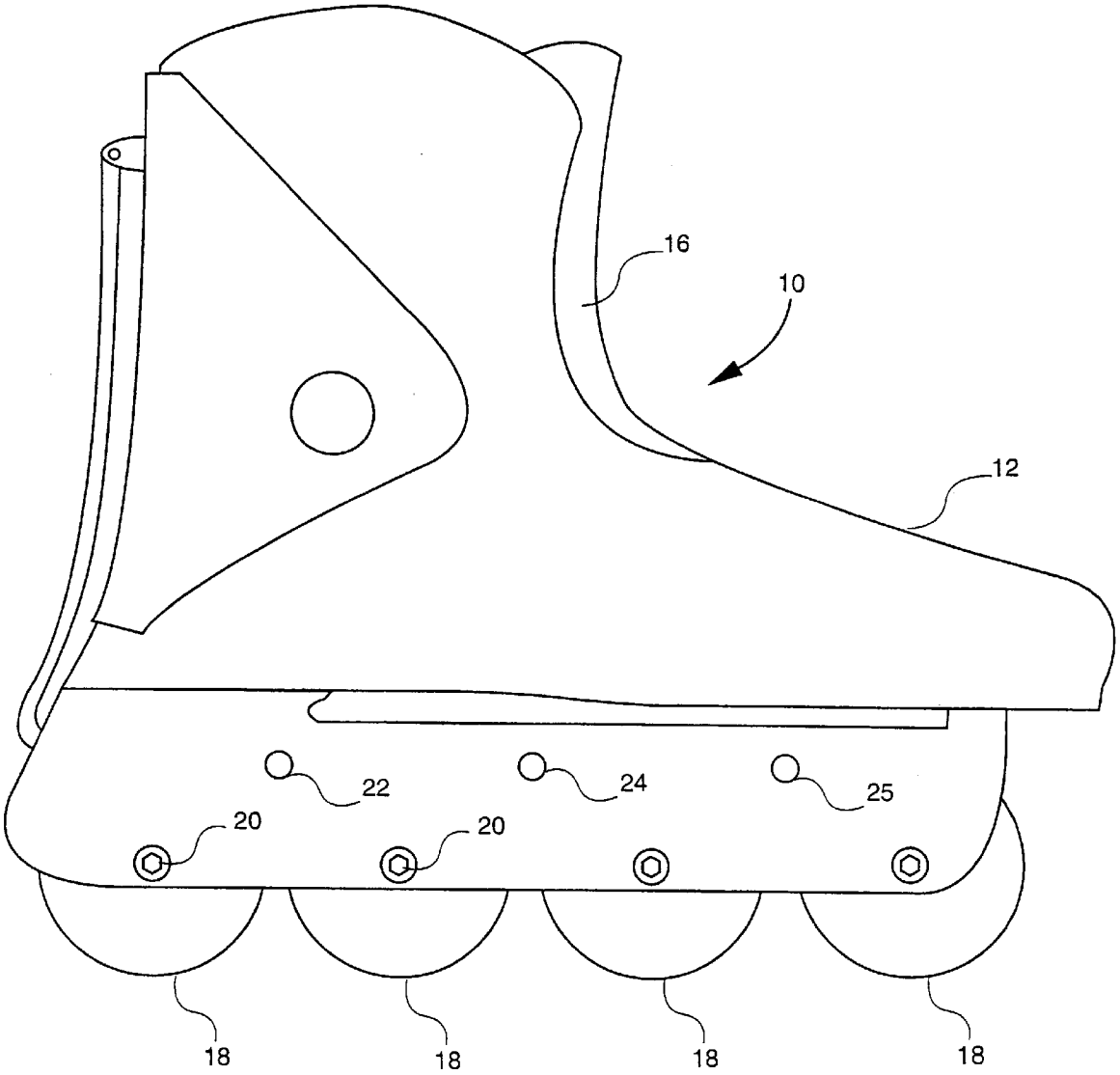
FIG. 1 is a perspective view of a roller skate having a braking system according to the present invention.

Referring now to FIG. 1, an embodiment of an in-line roller skate 10 which may incorporate braking systems according to the present invention will be described. Skate 10 includes a boot 12 and a frame 14 attached to or integrally formed with boot 12. Boot 12 may optionally include a rotatable cuff 16 which may be employed to actuate braking systems of the invention as described in greater detail hereinafter. Frame 14 holds a plurality of wheels 18 in line with each other and along a longitudinal axis of the skate. Wheels 18 are held to frame 14 by axles 20. Frame 14 further includes a pair of mounting holes 22 and 24 for mounting a braking system as described next with reference to FIGS. 2 and 3.

Figure 2:
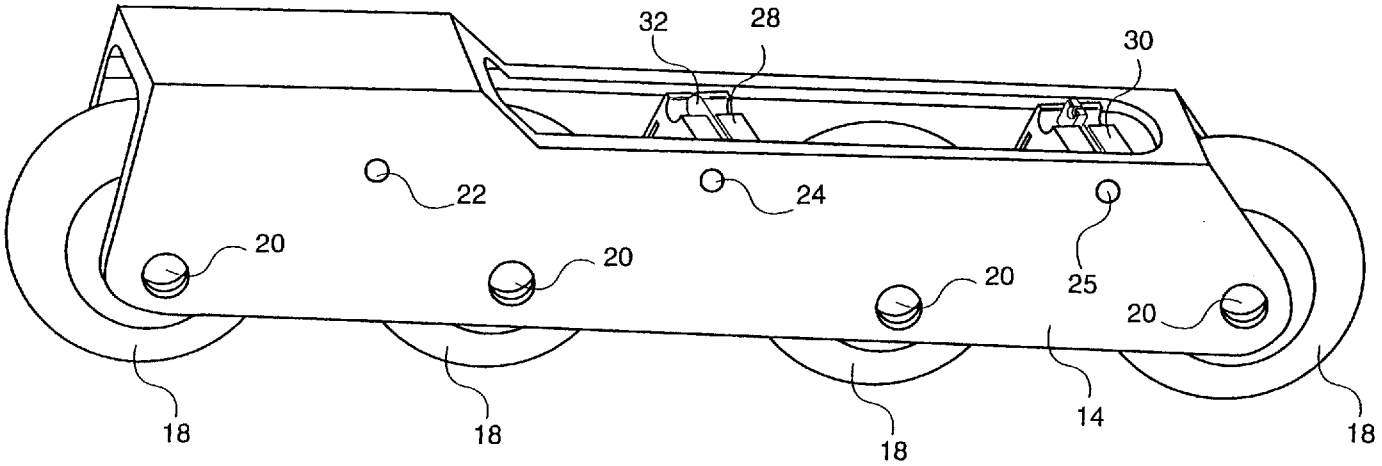
FIG. 2 is a perspective view of a frame of the roller skate of FIG. 1 which holds a plurality of wheels and the braking system.
Figure 3:
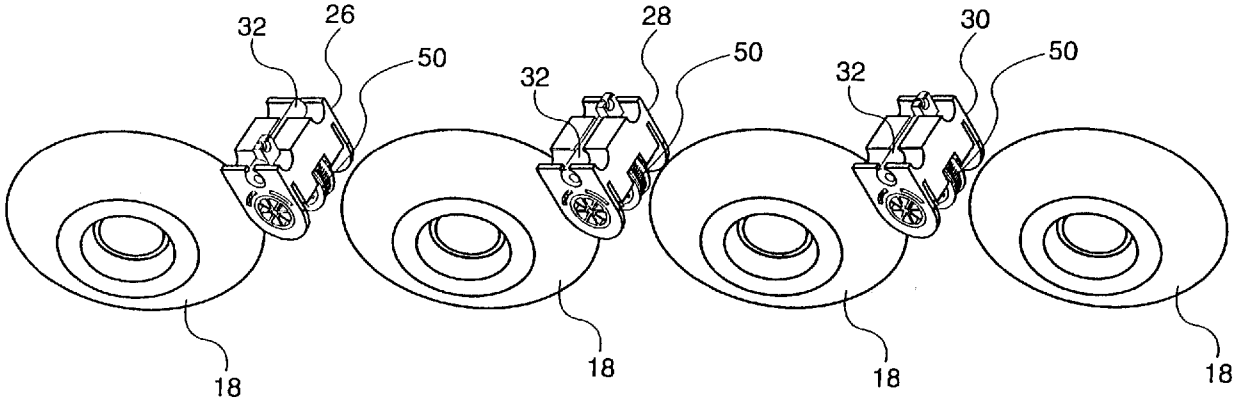
FIG. 3 is a perspective view of the wheels and the braking system of FIG. 2 with the frame shown removed.

Referring now to FIGS. 2 and 3, frame 14 holds a set of braking units 26, 28 and 30 above wheels 18. Although three braking units are shown, it will be appreciated that only one or two braking units may be included on a skate. Braking unit 26 is attached to frame 14 at mounting hole 22, braking unit 28 is attached to frame 14 at mounting hole 24, and braking unit 30 is attached to frame 14 at mounting hole 25. Braking units 26, 28 and 30 are held by frame 14 such that each braking unit is positioned in between and above two of the wheels 18 as shown. Braking units 26, 28 and 30 are attached to frame 14 by pins (not shown) extending through an eccentric cam 32 and terminating in mounting holes 22, 24, and 25, respectively.

Figure 4:
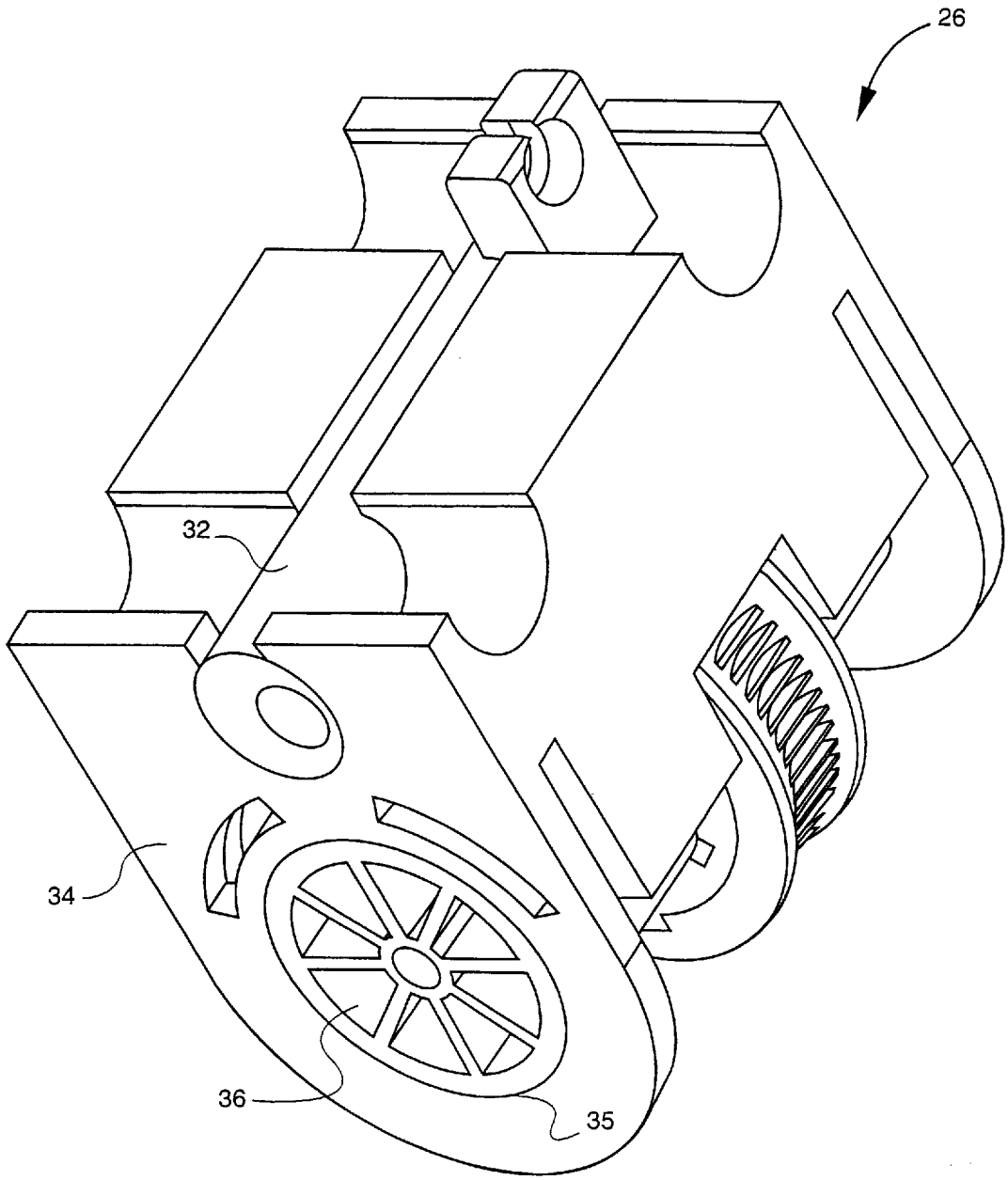
FIG. 4 is a perspective view of a braking unit of the braking system illustrated in FIGS. 2 and 3.
Figure 5:
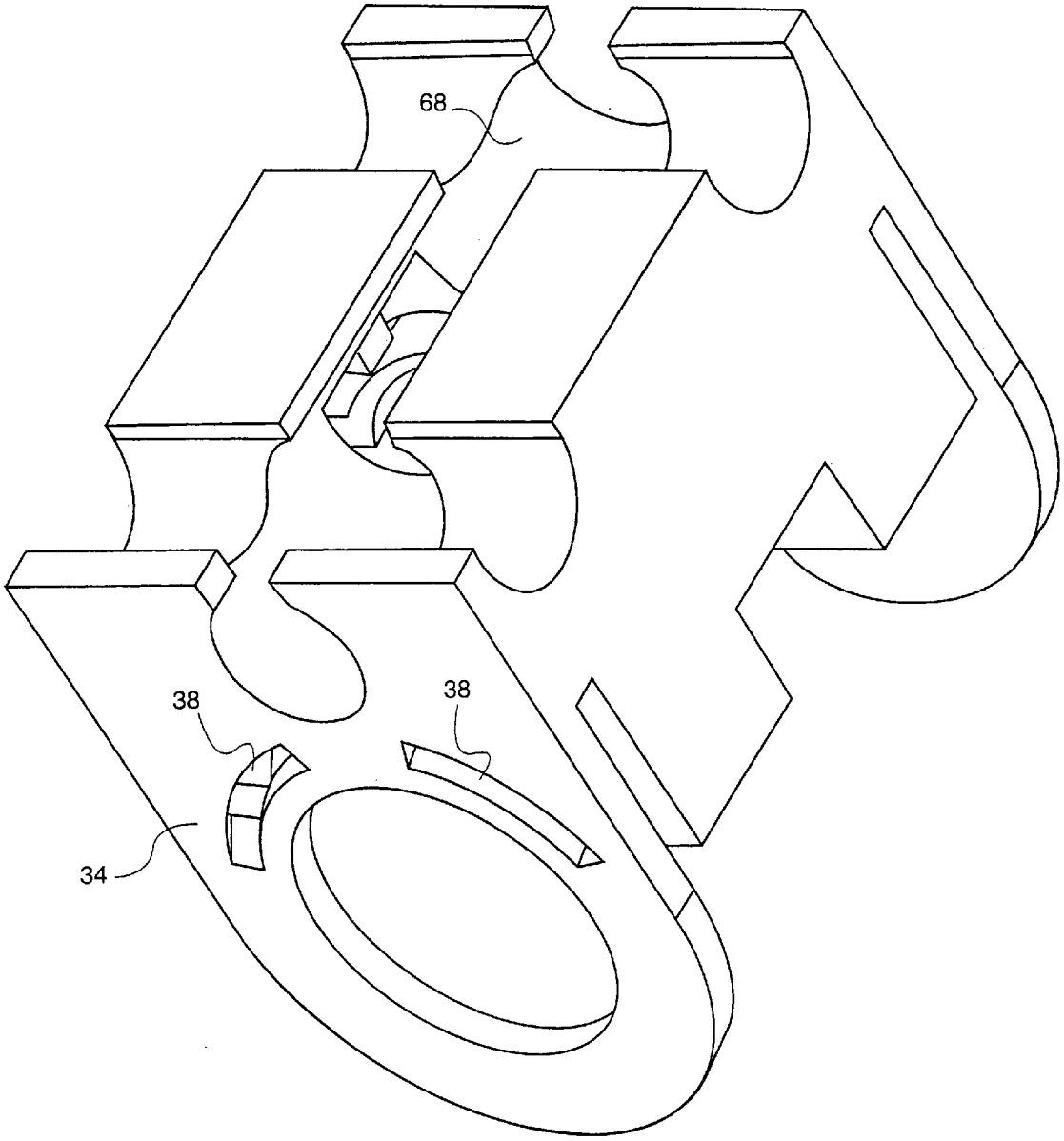
FIG. 5 is a perspective view of an elastomeric housing of the braking unit of FIG. 4.
Figure 6:
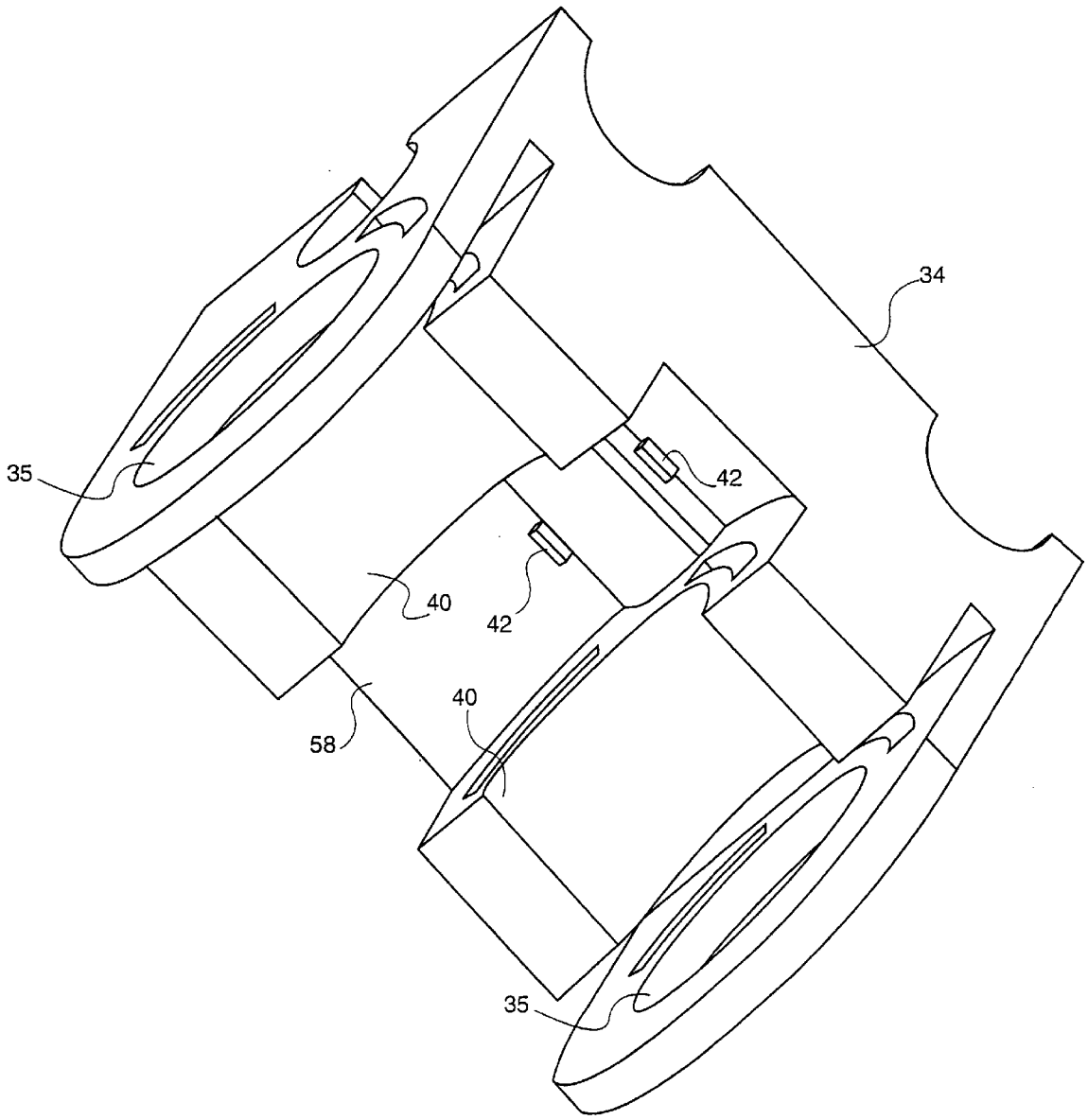
FIG. 6 is a perspective view of the elastomeric housing of FIG. 5 showing a pair of braking surfaces.

Referring to FIG. 4, construction of braking unit 26 will be described in greater detail, it being understood that braking units 28 and 30 are essentially identical to braking unit 26. Braking unit 26 comprises an elastomeric housing 34 which rotatably receives cam 32 and rotatable member 36. Elastomeric housing 34 is shown separately in FIGS. 5 and 6. Elastomeric housing is preferably constructed of an elastomer, such as rubber, so that housing 34 will be able to compress at slit 38 (see FIG. 5) and to withstand heat created at braking surfaces 40 (see FIG. 6) as described hereinafter. Tabs 42 may optionally be provided as wear indicators to indicate when braking surfaces 40 have become excessively worn.

Figure 7:
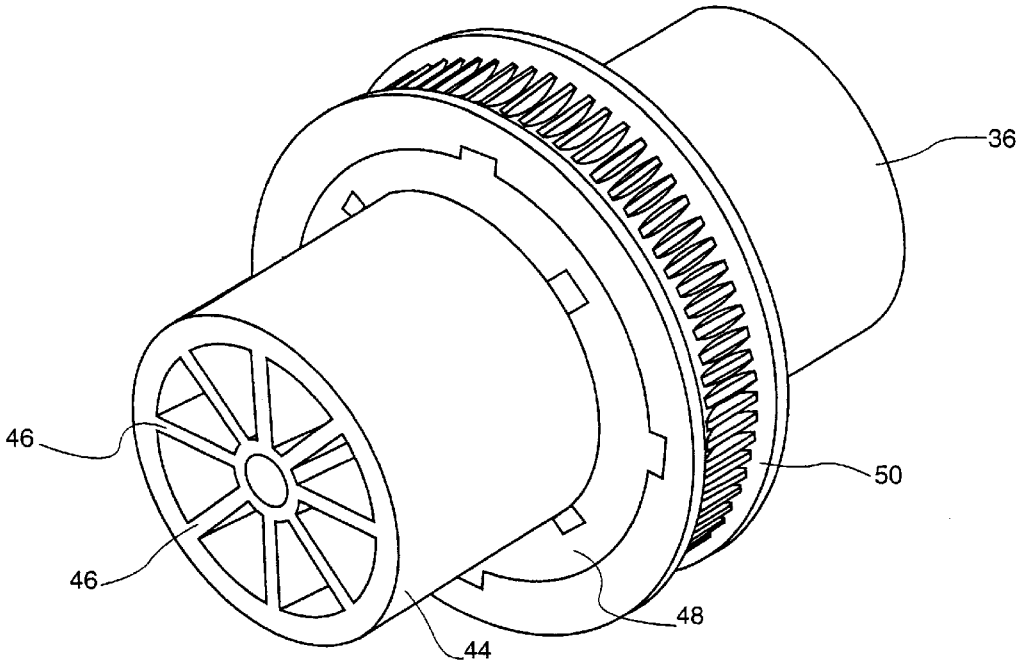
FIG. 7 is a perspective view of a rotatable member of the braking unit of FIG. 4.

Referring now to FIG. 7, construction of rotatable member 36 will be described in greater detail. Rotatable member 36 comprises a hollow shaft 44 having heat transfer fins 46. When rotatable member 36 is held within elastomeric housing 34 (see FIG. 4) shaft 44 is spaced apart from braking surfaces 40 (see FIG. 6). Shaft 44 is preferably constructed of a thermally conductive material such as aluminum, copper, steel, plastic, ceramic, and the like so that heat generated between shaft 44 and braking surfaces 40 will be transferred through fins 46 and will dissipate into the atmosphere, thereby preventing the heat from reaching wheels 18 (see FIG. 1). An insulating cylinder 48 is placed around shaft 44 for preventing heat from shaft 44 from transferring through a gear 50 to wheels 18.

Figure 8:
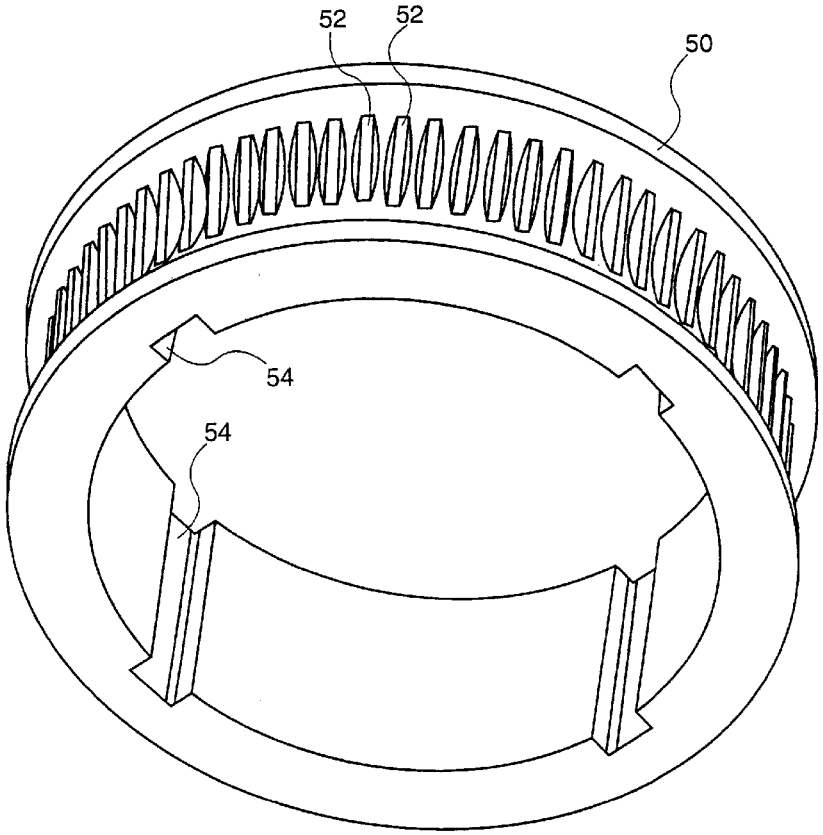
FIG. 8 is a perspective view of a gear, the rotatable member of FIG. 7.

Gear 50 is shown in greater detail in FIG. 8. Gear 50 may optionally include a plurality of ribs 52 which engage wheel 18 as described in greater detail hereinafter. Gear 50 includes a plurality of slots 54 which are received over elongate tabs 56 of insulating cylinder 48 to prevent rotation of gear 50 relative to shaft 44.

When rotatable member 36 is received in hole 35 of housing 34 (see FIG. 6) gear 50 is received into a curved slot 58 so that gear 50 will not come into contact with housing 34 except when engaging tabs 42 to indicate excessive wear of braking surfaces 40. In this manner, heat generated between braking surfaces 40 and shaft 44 will be substantially prevented from transferring to gear 50. In this manner, when gear 50 engages wheels 18 (see FIG. 2) heat will not be transferred to the wheels 18. Ribs 52 are optionally provided on gear 50 to prevent gear 50 from slipping when engaging wheels 18 as described in greater detail hereinafter.

Referring to FIG. 9, construction of cam 32 will be described. Cam 32 comprises an eccentric shaft 60 having a lumen 62 extending therethrough. A pin (not shown) is placed through lumen 62 to connect cam 32 to frame 14 as shown in FIG. 2. In this manner, cam 32 may be rotated relative to frame 14 when responding to a force to a lever arm 64. Lever arm 64 includes an aperture 66 to which a cable, rod, or the like may be placed to rotate cam 32. Cam 32 is rotatably received within a cylindrical opening 68 (see FIGS. 4 and 5) of housing 34. Since opening 68 is cylindrical, when cam 32 is rotated relative to housing 34, housing 34 will be directed downward relative to frame 14.

Referring back now to FIGS. 2 and 3, operation of braking units 26, 28 and 30 to slow or stop wheels 18 of skates 10 will be described. Cam 32 of braking units 26, 28 and 30 will preferably be interconnected by a cable or rod so that cam 32 of braking units 26, 28 and 30 will be rotated at the same time and rate. Cams 32 of braking units 26, 28 and 30 may be actuated by a cable or a rod extending to cuff 16 (see FIG. 1) so that as the cuff 16 is pivoted with the skater's leg, the braking system will be actuated. Other actuators include hydraulic actuators, solenoids, and the like.

Upon rotation of cam 32, elastomeric housing 34 is moved downward toward wheels 18 until gear 50 engages the pair of wheels 18 positioned below it. Preferably, gear 50 will engage both wheels above which it is positioned at substantially the same time. Further, since braking units 26, 28 and 30 will preferably be actuated at the same time, all four wheels 18 will preferably come into contact with a respective gear 50 at the same time. Rotatable member 36 is completely rotatable within holes 35 so that as gear 50 comes into contact with wheels 18, rotatable member 36 will freely rotate. In this manner, the skater will not feel a sudden jerk as gear 50 engages wheels 18. Further since rotatable member 36 may freely rotate within hole 35 of housing 34, virtually no slippage will occur between gear 50 and wheels 18. In this manner, substantially no heat will be generated between wheels 18 and gear 50.

As cam 32 is further rotated, housing 34 begins to compress at slit 38. As housing 34 compresses, braking surfaces 40 (see FIG. 5) come into contact with shaft 44 (see FIG. 7). When shaft 44 engages braking surfaces 40, shaft 44 will be rotating due to engagement with wheels 18. Housing 34 will be constructed to be sufficiently resilient so that shaft 44 will slowly and gently come into contact with braking surfaces 40 so that no jerky movements will be felt by the skater. As cam 32 continues to rotate, braking surfaces 40 will be further pressed against rotating shaft 44 to slow shaft 44. In turn, gear 50 will slow engaged wheels 18. Since gear 50 includes ribs 52, gear 50 will not slip relative to wheels 18 to provide a smooth slowing of wheels 18.

The heat generated between shaft 44 and braking surfaces 40 will be transferred through fins 46 and dissipated into the atmosphere. Insulating cylinder 48 will substantially prevent any heat from transferring to gear 50 so that the heat created at the braking surfaces 40 will be substantially prevented from reaching wheels 18 and causing damage thereto.

Since braking units 26, 28 and 30 may be configured to equally engage all of the wheels 18, wheels 18 will generally be slowed at about the same rate and at about the same time. In this manner, one or more of the wheels will not prematurely lock up. Rather, all of wheels 18 will slow equally.

When the skater has sufficiently slowed or stopped, cams 32 are rotated in the opposite direction to lift braking units 26, 28 and 30 from wheels 18 so that wheels may freely rotate.

A variety of schemes may be employed to move braking units 26, 28 and 30 into wheel engagement. One such system is illustrated in FIGS. 9A and 9B. Cables 300, 302 and 304 are attached to cams 32 of each of the braking units. Cables 300, 302 and 304 are attached at their opposite ends to a holding element 306 having a rotatable wheel 308. As illustrated in FIG. 9B, wheel 308 rests in a bean shaped aperture 310 of a slidable member 312 which in turn is pivotally attached to a rod member 314. A pin 316 is provided to attach rod member 314 to a cuff of the skate. In this way, when the skater moves the cuff, rod member 314 is lowered to move wheel 308 within aperture 310. This action causes holding element 306 to move to the left to tension cables 300, 302 and 304 and to move braking units 26, 28 and 30 into wheel engagement. When rod member 314 is moved upward, the tension in the cables is released and the braking action stops.

Figure 10:
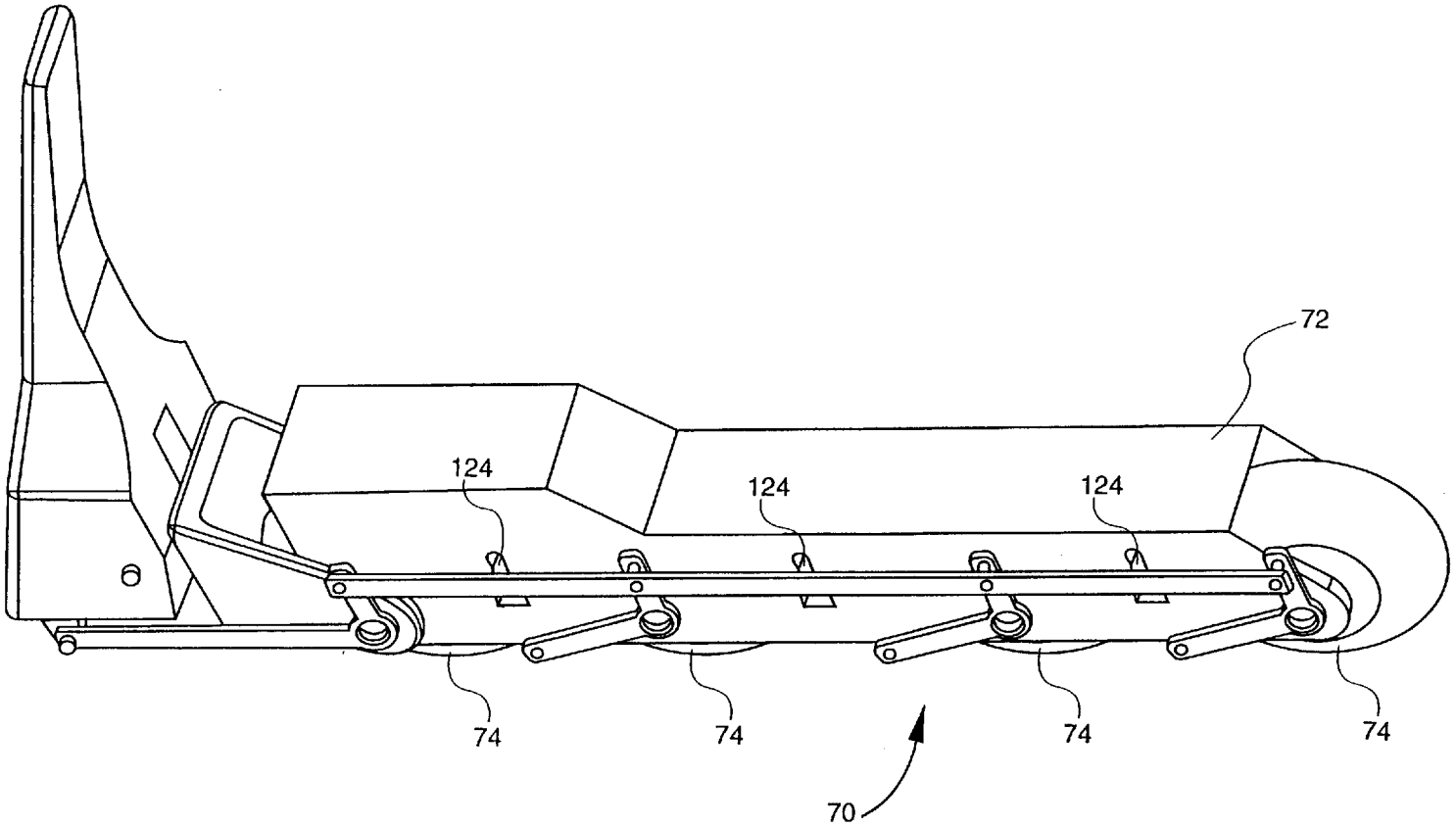
FIG. 10 is a perspective view of an alternative embodiment of a braking system according to the present invention.
Figure 11:
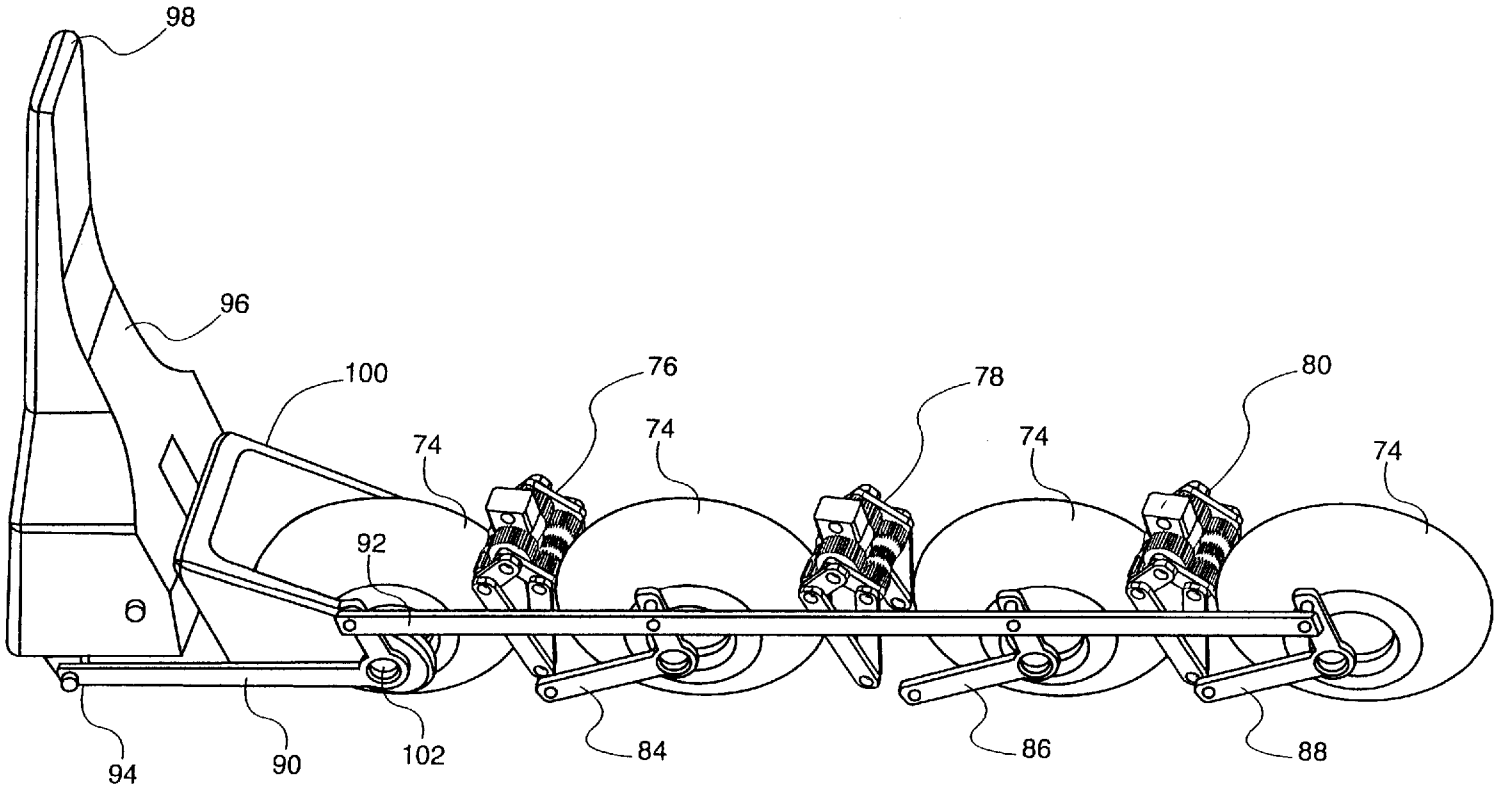
FIG. 11 illustrates the braking system of FIG. 10 with a skate frame being removed.

Referring to FIG. 10, an alternative embodiment of a braking system 70 will be described. Braking 70 includes a frame 72 which holds a plurality of in-line wheels 74 to a boot (not shown). As best shown in FIG. 11 (where frame 72 has been removed), braking system 70 further includes three braking units 76, 78 and 80. Braking system 70 may employ one or more of braking units 76, 78 and 80. Braking units 76, 78 and 80 are each pivotally connected to central rail 82 by rocker arms 84, 86 and 88. For convenience of illustration, rocker arms 84, 86 and 88 are shown disconnected from central rail 82 and braking units 76, 78 and 80. However, it will be understood that appropriate pins will be provided to pivotally connect braking units 76, 78 and 80 to central rail 82 via rocker arms 84, 86 and 88. A back rocker arm 90 is pivotally attached to a rear end 92 of central rail 82 and translates central rail 82 in a generally back and forth motion when an end 94 of back rocker arm 90 is translated up and down.

To translate end 94 in a generally up and down motion, a female member 96 is provided. Female member 96 is connected to a cuff of the roller skate boot (not shown) at a proximal end 98 similar to the female member described in co-pending U.S. application Ser. No. 08/571,795, filed Dec. 13, 1995 (Attorney Docket No. 17251-000600), the complete disclosure of which is incorporated herein by reference. Female member 96 slides over a male member (not shown) which is attached to a carriage 100 which is non-movably attached to a rear axle 102 of rear wheel 74. In this manner, as the boot cuff is pivoted back and forth by the skater's leg, female member 96 is translated in a generally up and down motion to translate central rail 82 in a generally back and forth motion. Often, female member 96 may include a braking pad as described in co-pending U.S. application Ser. No. 08/571,795, previously incorporated by reference. It will be understood that other actuators may be employed to translate central rail 82 including a hydraulic system, a solenoid, and the like.

As female member 98 is translated downward, rocker arms 84, 86 and 88 pivot about the axles of wheels 74 to move braking units 76, 78 and 80 into contact with wheels 74.

Figure 12:
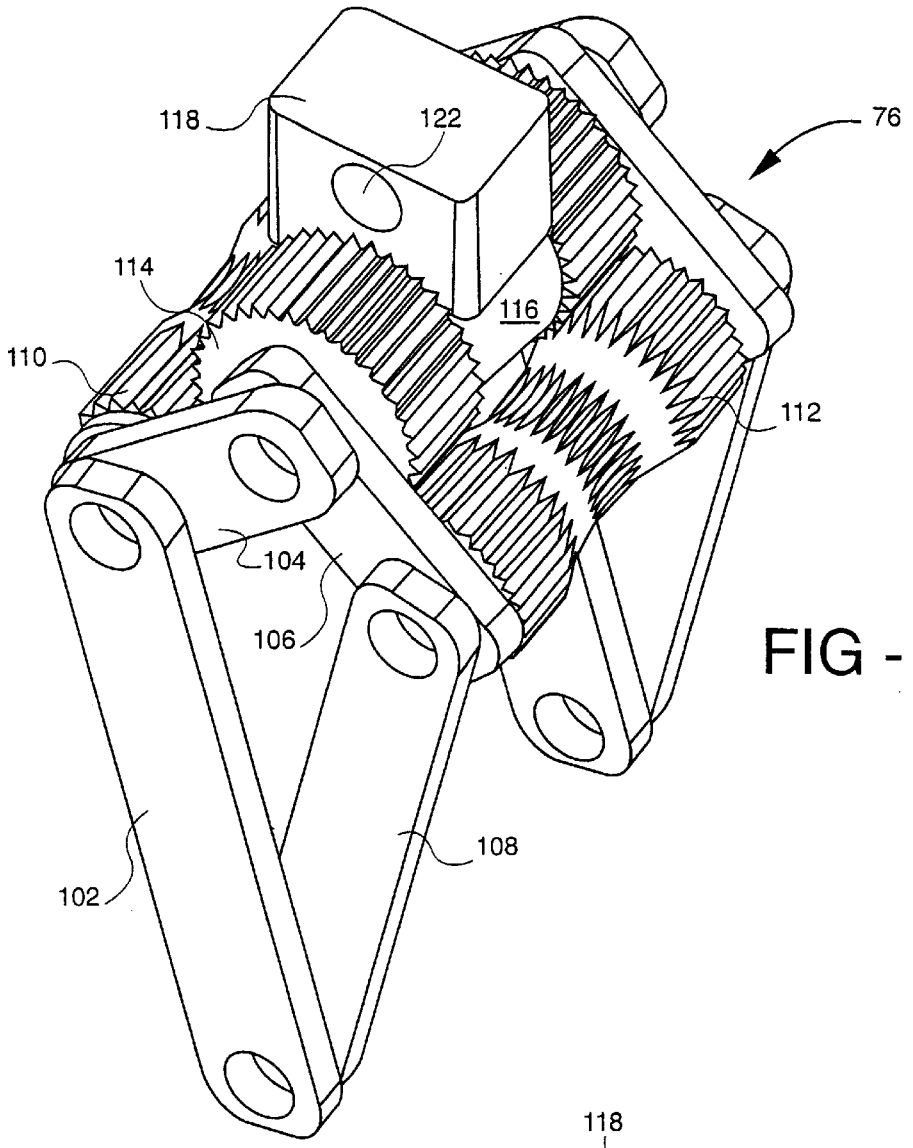
FIG. 12 is a perspective view of a braking unit of the braking system of FIG. 11.
Figure 13:
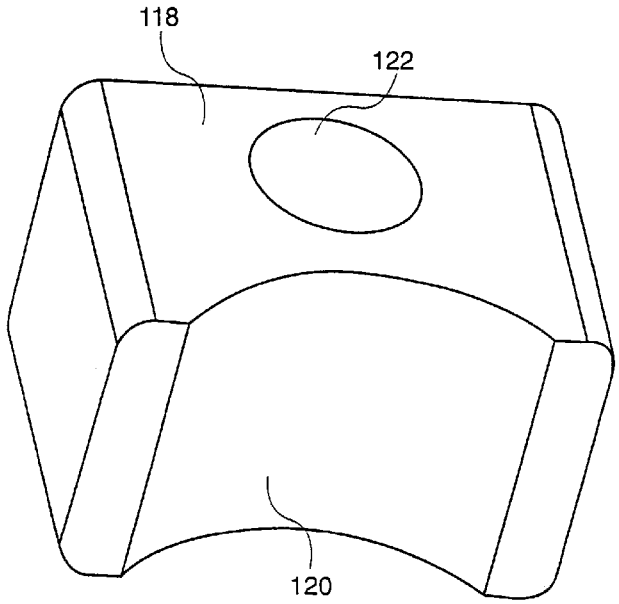
FIG. 13 is a perspective view of a braking pad of the braking unit of FIG. 12.

Referring now to FIG. 12, operation of braking units 76, 78 and 80 will be described. FIG. 12 illustrates braking unit 76, it being understood that braking units 78 and 80 are essentially identical to braking unit 76. Braking unit 76 includes four linkages 104, 106, 108 and 110 on each side. Linkages 104–108 are pivotally connected to each other by pivot pins (not shown). Braking unit 76 further includes two side gears 110 and 112 and a center gear 114. Side gears 110 and 112 come into contact with wheels 74 when braking unit 76 is lowered. Side gears 110 and 112 may optionally include ribs to prevent slippage of wheel 74 relative to side gears 110 and 112. Center gear 114 includes a central portion 116 which is spaced apart from the braking pad 118. Braking pad 118 is shown in FIG. 13 and includes a braking surface 120 which is designed to contact central portion 116 of gear 114. Braking pad 118 is preferably constructed of an elastomeric material such as rubber. Braking pad 118 is mounted to frame 72 (see FIG. 10) by a pin (not shown) extending through a lumen 122 of braking pad and into an aperture 124 of frame 72.

Referring back now to FIG. 11, operation of braking system 70 to slow or stop the skate will be described. When female member 96 is translated downward, rocker arms 84, 86 and 88 will pull on linkages 102 and 108 until side gears 110 and 112 come into contact with adjacent wheels 74 (see FIG. 12). As side gears 110 and 112 contact wheels 74, they will begin to rotate. In turn, central gear 114 will also rotate. Since braking pad 118 is spaced apart from central portion 116, center gear 114 will freely rotate and will not cause a jerking reaction that may be felt by the skater. As female member 96 is translated further downward, linkages 102 and 108 are forced together to drive gear 114 toward braking pad 118. As central portion 116 engages braking pad 118, rotation of center gear 114 will gently begin to slow in turn causing side gears 110 and 112 to slow, thereby smoothly slowing the engaged wheels 74.

Side gears 110 and 112 and/or portions of center gear 114 will preferably be constructed of an insulated material such as a ceramic, so that heat generated between central portion 116 and braking pad 118 will not be transferred to wheels 74. In this manner, the heat generated in slowing or stopping wheels 74 will be kept away from the wheels. After wheel 74 has been slowed to the desired amount, female member 96 is translated upwards to disengage braking unit 76, 78 and 80 from wheels 74.

Figure 14A:
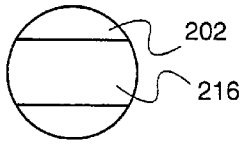
FIG. 14A illustrates an end view of a friction hub employed in an alternative braking system according to the invention.
Figure 14B:
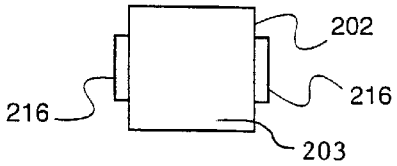
FIG. 14B illustrates a side view of the friction hub of FIG. 14A.
Figure 15A:
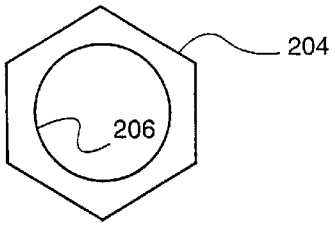
FIG. 15A illustrates an end view of an elastomeric friction pad.
Figure 15B:
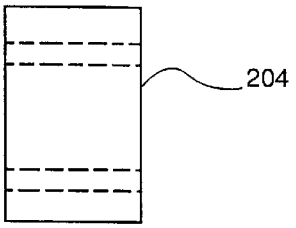
FIG. 15B illustrates a side view of the friction pad of FIG. 15A.
Figure 15C:
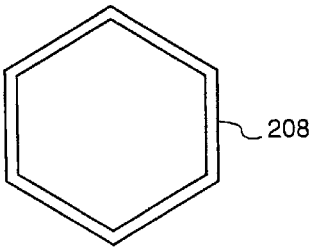
FIG. 15C illustrates an end view of an insulating member.
Figure 15D:
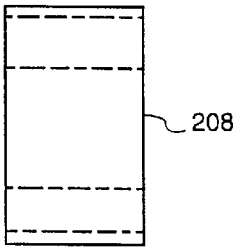
FIG. 15D illustrates a side view of the insulating member of FIG. 15C.
Figure 16A:
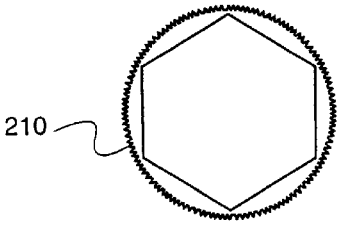
FIG. 16A illustrates an end view of a wheel engaging hub.
Figure 16B:
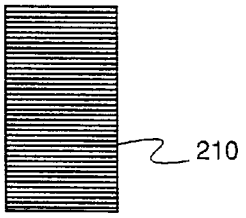
FIG. 16B illustrates a side view of the engaging hub of FIG. 16A.
Figure 17A:
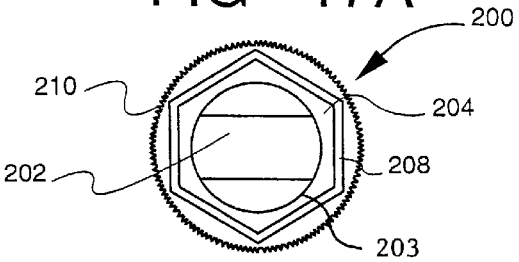
FIGS. 17A and 17B illustrates the assembly of the friction hub, friction pad, insulating member and engaging hub of FIGS. 14A, 15A, 15C and 16A to form a brake unit.
Figure 17B:
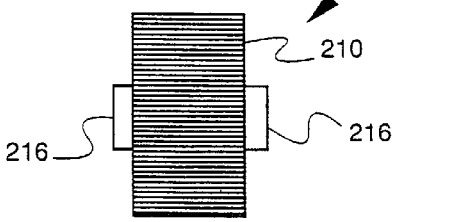

FIGS. 17A and 17B illustrate an alternative embodiment of a braking unit 200 according to the invention. The components of braking unit 200 are illustrated in FIGS. 14–16, it being appreciated that the drawings are not necessarily shown to scale. As illustrated in FIGS. 14A and 14B braking unit 200 includes a friction hub 202 that is preferably constructed of aluminum (which is a good conductor of heat), although other durable materials could be used. Friction hub 202 preferably includes a roughened braking surface 203, such as by knurling or by providing serrations. The friction hub 202 is inserted into a friction pad 204 (see FIGS. 15A and 15B) having an inner surface or bore 206. Friction hub 204 is preferably constructed from an elastomeric material, rubber, cork, asbestos, and the like. Various combinations of materials may also be used to create friction surfaces, including, cork and rubber, metal on metal, soft steel on phosphor bronze, and the like. The interface between the friction hub and the friction pad should produce sufficient friction for stopping while also providing exemplary wear characteristics. The friction pad may optionally be inserted into an insulator 208 (see FIGS. 15C and 15D) which is then inserted into an outer wheel engaging hub 210 or drive roller (see FIGS. 16A and 16B). Hub 210 will preferably have a roughened surface, such as by including serrations or by knurling the surface, to prevent slippage of hub 210 when it engages the wheels.

Figure 18:
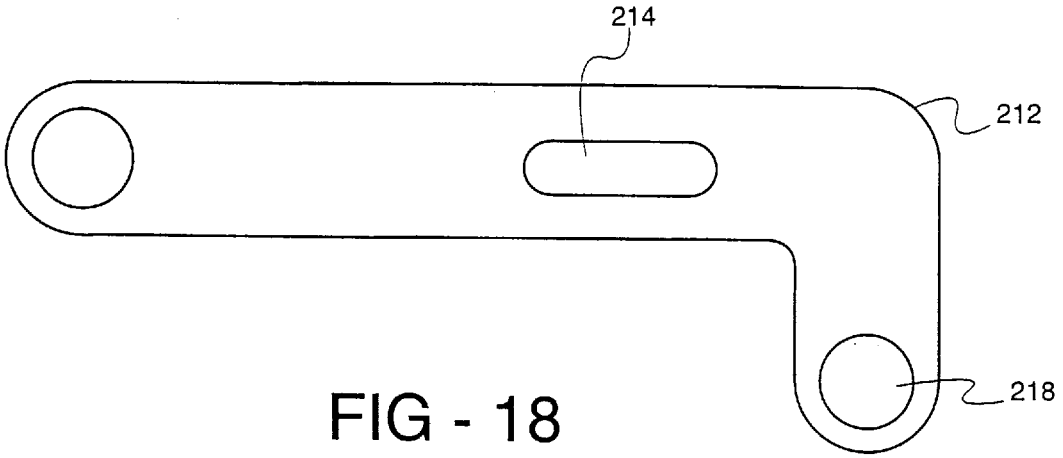
FIG. 18 illustrates a side view of a brake arm according to the invention.
Figure 19:
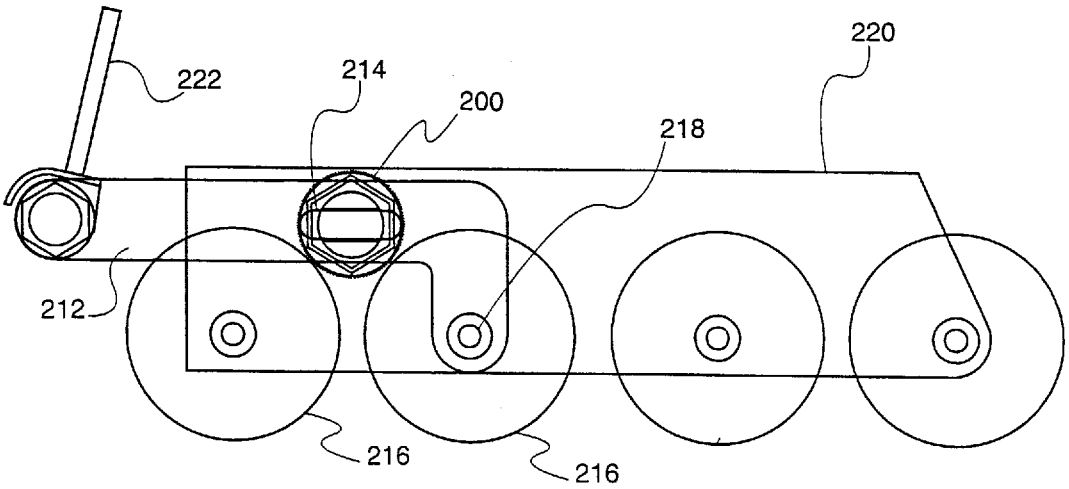
FIG. 19 illustrates one embodiment of a braking system employing the brake arm of FIG. 18 and the brake unit of FIG. 17.

FIG. 19 illustrates brake unit 200 attached to a brake arm 212 (see FIG. 18) having a slot 214 for receiving protrusions 216 on friction hub 202 (See FIGS. 14A and 14B). For convenience of illustration, frame 220 and brake arm 212 are shown to be transparent. Protrusions 216 are slidable within slot 214 to allow brake unit to properly adjust its orientation when engaging wheels 216 of a skate as illustrated in FIG. 19. Brake arm 212 is pivotally mounted at a pivot point 218 to a frame 220 of the skate. When arm 212 is pivoted downward, wheel engaging hub 210 is engaged between a pair of wheels 216 by a force. In turn, wheel engaging hub 210 is compelled to rotate by the turning wheels of the skate, similar to the engagement of gears one with another.

As the wheel engaging hub 210 rotates, the friction pad 204 is rotated at the same rate by virtue of its engagement within the wheel engagement hub (facilitated by the hexagonal geometry). Braking results when the inner surface 206 of the friction pad 204 rotates around the friction hub 202. In turn, the friction hub 202 (which is constrained not to rotate by engagement of protrusions 216 within slot 214) provides a friction surface for the friction pad 204. The surface texture of the friction pad 204, combined with the compound type and hardness of the friction pad 204, serves to slow rotation of wheel engaging hub 210 which in turn resists the turning motion of the skate wheels 216. In this way, wheel engaging hub 210 serves to slow the skate to which the wheels are attached with minimal or no slippage of wheel engaging hub 210. Conveniently, the insulator 208 serves to prevent the generated heat from transferring to the outer hub 210 to protect the wheels.

One advantage of such a system is that essentially no jerking action is produced when the brake is engaged. Since the amount of braking is generally proportional to the force being applied to actuate the braking system, a smooth slowing action is produced when the brake is applied.

It will be appreciated that a variety of mechanisms may be employed to engage the friction hub with the friction material rotating around the friction hub. For example, such mechanisms may include, centrifugal engagement, magnetic engagement, slip couplings, wrapped spring clutches, band clutches, and other mechanisms which allow the friction hub to be engaged with the outer hub to facilitate controlled, adjustable slippage between the two hubs.

One particular advantage of brake unit 200 is that it remains spaced-apart from the wheels when not in use. In this way, brake unit 200 does not slow the turning wheels (by providing a frictional force on the wheels) until actuated by the skater. Hence, the braking system is able to rapidly slow or stop a skater without hindering the gliding ability of the skate. Further, since brake unit 200 is held within frame 200, brake unit 200 will not interfere with movement of the skates, such as when performing cross-overs.

As illustrated in FIG. 19, the brake arm 212 is actuated by a rod 222 or other rigid member which extends to a cuff. Alternatively, an elongated member or paddle as shown in FIG. 33 of U.S. patent application Ser. No. 08/664,068, previously incorporated by reference (and as illustrated in FIG. 22C herein), may be employed to activate either a rod, a lever, a cable or the like to move brake unit 200 into wheel engagement. As another alternative, one or more bladders (back, front, or sides of the skate leg) containing air or liquid may be used to move the brake arm.

As illustrated in FIGS. 20, 20A and 20B, the brake arm of FIG. 18 may be modified to includes a pair of brake units 200. As shown in FIG. 20A, a brake arm 224 includes a wheel pivot point 226 and a linkage pivot point 228. A linkage 230 (see FIG. 20B) is pivotally attached to pivot point 228 and has a pair of slots 232 and 234 for receiving brake units 200 as shown in FIG. 20. In this way, as brake arm 224 is pivoted downward, brake units 200 engage wheels 216 to slow or stop the skate in a manner similar to that previously described in connection with FIG. 19. For convenience of illustration, frame 220, brake arm 224 and linkage 230 are shown to be transparent.

Braking with brake units 200 is generally a two step process which allows for controlled slowing of the skate, i.e. without creating a jerking action or locking up of the wheels. In the first step, wheel engaging hub 210 initially comes into contact with the rotating wheels. The roughed surface of hub 210 allows hub 210 to begin rotating. Further, a sufficient gap is provided between inner surface 206 and friction hub 202 so that wheel engaging hub 210 may easily rotate when coming into contact with the rotating wheel.

As part of the first step, slots 232 and 234 allow braking units 200 to position themselves between a pair of wheels. In this way, braking units 200 will be in contact with and rotating between two wheels in a smooth manner before braking begins.

In step two, braking begins by increasing the force at which wheel engaging hub 210 is pressed against the rotating wheels. At this point inner surface 206 is forced into contact with friction hub 202 to begin braking. In this way, essentially all of the braking units will be positioned correctly between their associated wheels before braking begins so that braking will occur in a controlled and smooth manner.

As illustrated in FIGS. 21–21C, a brake arm 236 may be provided for receiving three brake units 200. As shown in FIG. 21A, brake arm 236 includes a wheel pivot point 238 and a linkage pivot point 240. A linkage 242 (see FIG. 21B) is pivotally attached to pivot point 240 and has a slot 244 for receiving one of the brake units 200. A second linkage 245 (see FIG. 21C) is pivotally attached to the first linkage 242 at a pivot point 246. Second linkage 245 includes a pair of slots 248 and 250 for receiving brake units 200 as shown in FIG. 21. In this way, as brake arm 236 is pivoted downward, brake units 200 engages all four wheels 216 to slow or stop the skate in a manner similar to that previously described in connection with FIGS. 19 and 20. For convenience of illustration, frame 220, brake arm 236, linkage 242 and linkage 245 are shown to be transparent.

Alternatively, as illustrated in FIG. 22, a pair of lever arm members 252 and 254 may be used in combination to move brake unit 200 into contact with a pair of wheels 216. Arm 252 (see FIG. 22A) will preferably be longer than arm 254 (see FIG. 22B) and will preferably be attached to an axle 256 and positioned exterior to frame 220 of the skate. Arm 254 is also attached to axle 256 and is positioned in the interior of skate frame 220. Arms 252 and 254 are attached together at their distal ends so that when rod 222 is lowered, a slot 258 in arm 254 having brake unit 200 will be lowered to move brake unit 200 into engagement with wheels 216. For convenience of illustration, frame 220 and arm members 252, 254 are shown to be transparent.

As illustrated in FIG. 22C, brake units 200 may be placed into wheel engagement by employing a paddle 340 which is placed in the interior of the shoe or boot of the skate similar to the embodiments described in copending application Ser No. 08/664,068, previously incorporated by reference. Paddle 340 is pivotally attached to the frame 220 and includes a pin 342 which slides in an aperture 344 of a brake arm 346 (which may be constructed similar to the brake arms previously described herein). When a skater pushes back on paddle 340, pin 342 pushes brake arm 346 in a generally downward direction so that it will pivot about front axle 238 to move braking units 200 into wheel engagement similar to the embodiments previously described. When the pressure is released from paddle 340, a spring or other biasing member (not shown) will push paddle 340 forward to cease the braking action.

Referring now to FIG. 23, an alternative embodiment of a braking system 260 will be described. Braking system 260 operates in a manner similar to the brake system illustrated in FIG. 19, except that braking system 260 is actuated by an eccentric pivot via a cable, lever, rod or the like. As best shown in FIGS. 23 and 24, brake system 260 comprises a plurality of brake units 262 which are pivotally attached to the frame of the skate (not shown). Brake units 262 are similar to brake units 200 as previously described and comprise an outer wheel engaging hub 264 (or drive roller), a friction pad 266 held within wheel engaging hub 264 and a friction hub 268 disposed within friction pad 266. Friction hub 268 includes an eccentric pivot point 270 which allows friction hub 268 to be pivotally mounted to the skate frame.

As also shown in FIGS. 36 and 37, friction hub 268 includes a cable slot 272 for receiving a cable 274 (see FIG. 24). A set screw 276 is employed to secure cable 274 to friction hub 268. In this way, when tension is applied to cable 274, brake unit 262 pivots about point 270 causing wheel engaging hub 264 to move into engagement with wheels 278 of the skate in a smooth manner. In turn, wheel engaging hub 264 and friction pad 266 are caused to rotate by the rotating wheels similar to brake unit 200 as previously described, without causing a jerking action on the skate. Since friction hub 268 is prevented from rotating by the skate frame, a frictional force will be created between friction pad 266 and friction hub 268. In turn, the rotation rate of wheel engaging hub 264 will be slowed, thereby causing wheels 278 to slow or stop. As shown in FIGS. 38 and 39, friction hub 268 may be provided with a torsion spring 280 which is attached to the skate frame. Torsion spring 280 moves brake unit 260 out of wheel engagement after the tension in cable 274 is released.

Figure 26:
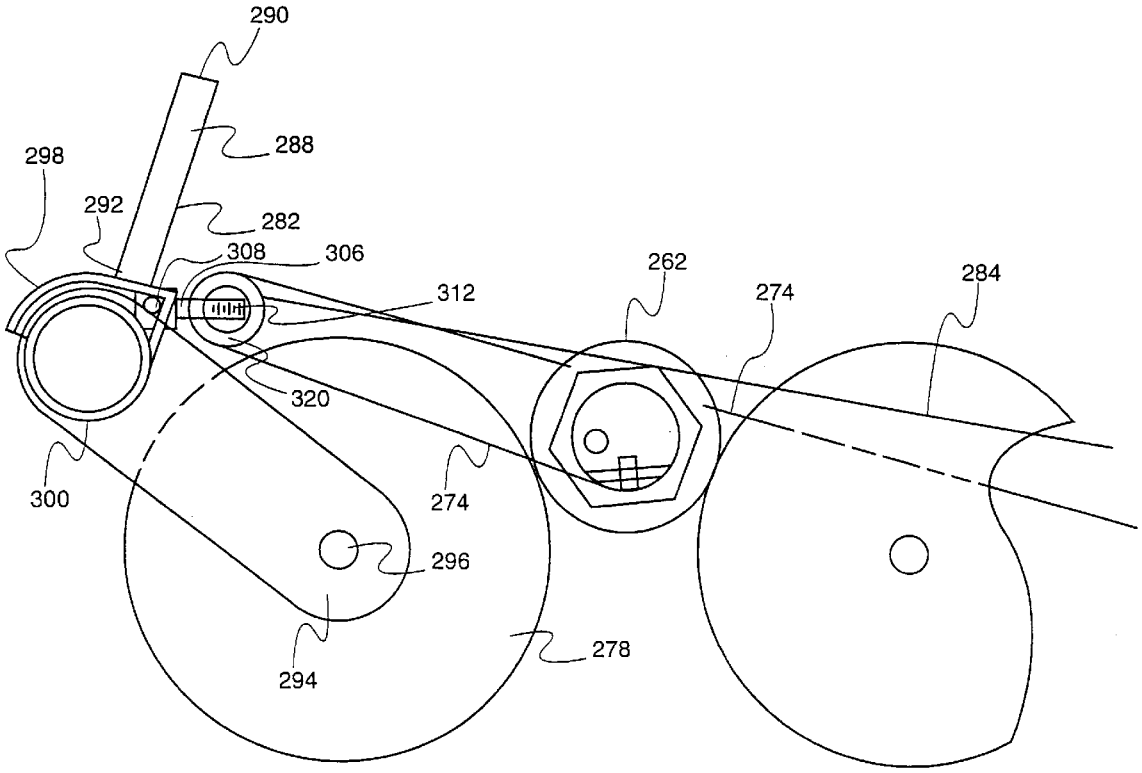
FIG. 26 is a more detailed view of an activation mechanism for the system of FIG. 23.

As shown in FIGS. 23, 26 and 32, an actuating mechanism 282 is employed to tension cable 274 and a cable 284 in order to move the three brake units 262 into wheel engagement. Mechanism 282 comprises a rod 288 having a first end 290 and a second end 292. Second end 292 is attached to a base member 298 which is in turn is attached to a cylindrical member 300. Cylindrical member 300 is pivotally engaged with a linkage 294 which is turn is pivotally attached to an axle 296 of wheel 278. First end 290 is operably attached to a mechanism (not shown) for moving rod 288 to cause link 294 to rotate about axle 296. A variety of mechanisms as previously described herein may be employed to move rod 288, including a cuff of the skate or a paddle as described in copending application Ser. No. 08/664,068, previously incorporate by reference.

As best shown in FIG. 32, base member 298 includes a hole 302 and an aperture 304. A link member 306 (see also FIGS. 33 and 34) extends through aperture 304 and is pivotally attached to base member 298 by placing a pin 308 (see FIG. 26) through a lumen 310 in link member 306 and through hole 302. Link member 306 is also attached to a pivot member 312 (see FIGS. 29-31 and 35). As best shown in FIG. 35, link member 306 is slid into a slot 314 of pivot member 312 (see FIG. 31) and a pin 316 is employed to hold link 306 to pivot member 312.

Figure 25:
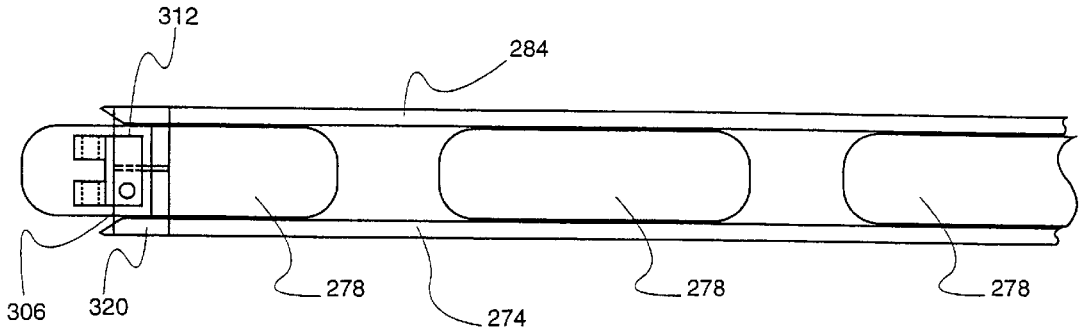
FIG. 25 is a partial top view of the brake system of FIG. 23.

Rotatably received about an end 318 of pivot member 312 is a spool 320 (see FIGS. 25, 27, 28 and 28A). Spool 320 includes a groove 322 for receiving cable 274. As best shown in FIGS. 23 and 25 spool 320 allows cable 274 to be attached to two braking units. An opposite end 322 of pivot member 312 includes a hole 324 into which an end of cable 284 is received (see FIG. 25). Hence, as best illustrated in FIG. 26, when rod 288 is moved in a generally downward direction, link 294 pivots about axle 296. In turn, link member 306 and pivot member 312 are moved generally to the left. This causes tension in cables 274 and 284 which in turn moves each of the three brake units 262 into wheel engagement. Once sufficient braking has occurred, the force on rod 288 is subsided to remove the tension in cables 274 and 284. Torsion spring 280 (see FIG. 38) then moves braking units 262 out of wheel engagement.

Cooling of the braking systems described herein may take place in a number of ways, including convection, conduction and radiation. One method of cooling is a closed system illustrated in FIG. 40 where liquid is drawn by means of a pump 300 that is driven by the rotation of the braking unit during braking. The fluid passes through a remotely located heat exchanger 302 after flowing through passages in a friction hub 304 of the braking unit.

Figure 40:
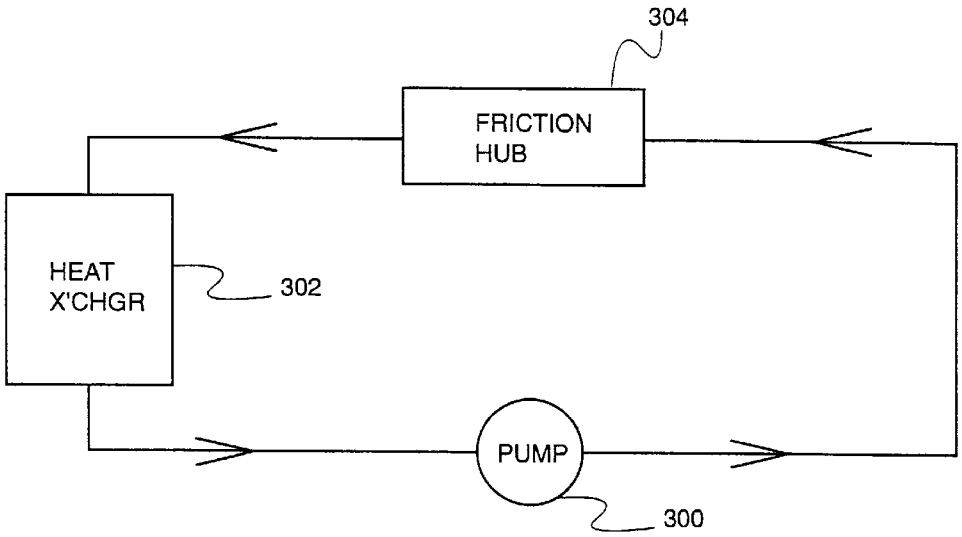
FIG. 40 is a schematic diagram of an alternative embodiment of a braking system according to the invention.
Figure 41:
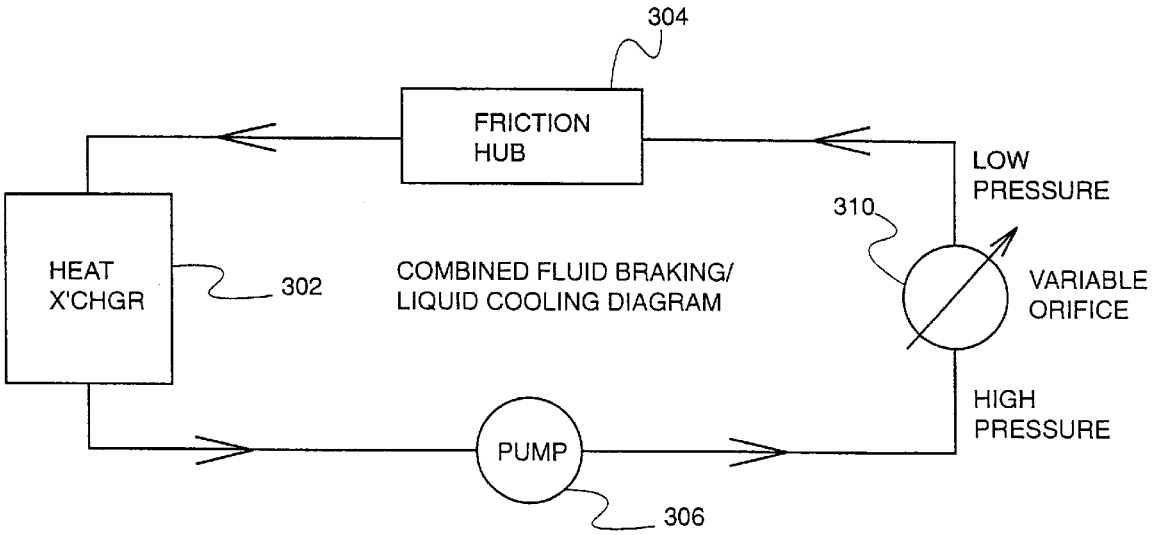
FIG. 41 is a schematic view of yet another alternative embodiment of a braking system according to the invention.

FIG. 41 illustrates another alternative cooling system which is similar to the system set forth in FIG. 40, except that the fluid is used in a torque converter pump 306 or similar device. In this way, the fluid is used to dissipate energy. By regulating the size of an orifice 310 in the circuit, the amount of resistance can be varied by the brake actuator. Cooling of the fluid, if required, is accomplished as previously described in connection with FIG. 40.

Pump 306 will preferably comprise a positive displacement fluid pump, such as a gear pump or piston pump. The working fluid will preferably comprise oil since it may also be used to lubricate the system. Because the oil is generally incompressible and a positive displacement pump is driving the system, the variable orifice may be used to vary the flow through the system, thereby increasing or decreasing the resistive or braking torque seen by the pump. Because the wheels of the skate are driving the pump during the application of the brake system, the wheels will in turn see a resistive torque as governed by the size of the variable orifice.

As a result of the work done by the system during braking, the oil temperature will rise. The heat energy in the oil is removed to the atmosphere as the oil passes through an appropriately sized heat exchanger that is preferably positioned outboard of the skate where optimum air flow may occur.

To activate the brake, the pump drive roller will preferably be applied to the wheel with little or no resistance to rotation, such that the skater will not experience any sudden jerking, but will be applied with sufficient force to transmit the torque loads required as the variable orifice is reduced in size as described below.

The pump drive roller is maintained against the wheels as the variable orifice is modulated in response to input from the skater. As resistance to flow increases in the system, actual braking occurs. The skater is able to modulate the size of the orifice as required to achieve the desired braking resistance at any time.

Although the foregoing invention has been described in some detail for purposes of clarity of understanding, alternative embodiments of the invention will occur to those skilled in the art. Therefore, the above description should not be taken as limiting the scope of the invention. Instead, the scope of the invention should be determined chiefly with reference to the appended claims, along with the full scope of equivalents to which those claims are entitled.

What is claimed is:

1. A braking system for a roller skate having a plurality of wheels, the system comprising:

at least one braking surface spaced-apart from the wheels; and a rotatable wheel engaging member between at least a portion of the braking surface and at least one of the wheels, the rotatable member having an inner surface which contacts the brake surface when forced against at least one of the wheels to slow or stop the wheel such that heat generated when slowing or stopping the wheel is created at the braking surface and is substantially prevented from reaching the wheel.

2. A system as in claim 1, wherein the wheels of the roller skate are in-line with each other, and wherein the rotatable member is positioned between one or more of the in-line wheels so that one or more wheels may be slowed or stopped at substantially the same time.

3. A system as in claim 1, wherein the braking surface is disposed within the rotatable member, wherein the rotatable member may be positioned to contact one of the wheels when rotating, wherein positioning of the rotatable member against the wheel causes the rotatable member to rotate, and wherein engagement of the braking surface with the rotating rotatable member slows rotation of the in-line wheel.

4. A system as in claim 3, wherein substantially no slippage occurs between the wheel and the rotatable member so that heat generated while slowing the wheel is generated away from the wheel at the braking surface.

5. A system as in claim 3, wherein the rotatable member may be positioned to contact one or more of the wheels at substantially the same time, wherein the two contacted wheels may be slowed by the rotatable member.

6. A system as in claim 3, further comprising an actuator which positions the rotatable member against the wheel and engages the braking surface with the rotatable member.

7. A system as in claim 6, wherein the actuator comprises a brake arm which moves the rotatable member into contact with the wheel upon movement of the brake arm.

8. A system as in claim 7, further comprising a cable connected to the brake arm, whereby the brake arm may be pivoted by pulling on the cable.

9. A system as in claim 7, further comprising an elastomeric housing, wherein the braking surface is positioned within the housing, and wherein the rotatable member is rotatably attached to the housing so as to be spaced-apart from the braking surface such that movement of the brake arm forces the rotatable member against the braking surface after the rotatable member contacts the wheel.

10. A braking system for a roller skate having a plurality of in-line wheels which rotate when the roller skate is rolling over a skating surface, the system comprising:

a rotatable member which may be positioned to contact at least one of the wheels when rotating, wherein positioning of the rotatable member against the wheel causes the rotatable member to rotate; and a braking surface disposable within and engageable with the rotatable member, wherein engagement of the braking surface with the rotating rotatable member slows rotation of the in-line wheel.

11. A system as in claim 10, wherein substantially no slippage occurs between the wheel and the rotatable member, and wherein heat generated while slowing the wheel is generated away from the wheel at the braking surface.

12. A system as in claim 10, wherein the rotatable member may be positioned to contact two of the wheels at substantially the same time, wherein the two contacted wheels may be slowed by the rotatable member.

13. A system as in claim 10, wherein at least a portion of the braking surface is thermally conductive so that heat generated between the rotatable member and the braking surface may be dissipated into the atmosphere.

14. A system as in claim 13, wherein at least a portion of the rotatable member is constructed of aluminum and includes a plurality of heat transfer ribs.

15. A system as in claim 13, wherein the rotatable member includes insulation for preventing heat generated at the braking surface from transferring to the wheel.

16. A system as in claim 10, further comprising an actuator which positions the rotatable member against the wheel to engage the braking surface with the rotatable member.

17. A system as in claim 16, wherein the actuator comprises a brake arm which moves the rotatable member into contact with the wheel upon movement of the brake arm.

18. A system as in claim 17, further comprising a rod connected to the brake arm, whereby the brake arm may be moved by pushing on the rod.

19. A system as in claim 17, further comprising an elastomeric housing, wherein the braking surface is positioned within the housing, wherein the housing is operably attached to the rotatable member so as to be spaced-apart from the braking surface such that movement of the brake arm moves the rotatable member into contact with the wheel and then forces the housing against the braking surface after the rotatable member contacts the wheel, and wherein the brake arm is pivotally connected to a skate frame.

20. A system as in claim 17, further comprising a cable operably attached to the brake arm and an eccentric member having the braking surface so that tensioning of the cable by the brake arm moves the rotatable member in contact with the wheel.

21. A roller skate, comprising:

a boot;

a frame which connects a plurality of in-line wheels to the boot;

a braking surface operably attached to the frame; and a rotatable member between at least a portion of the braking surface and at least one of the wheels for slowing or stopping the wheel such that heat generated when slowing or stopping the wheel is created at the braking surface and is substantially prevented from reaching the wheel.

22. A method for slowing or stopping a moving roller skate, comprising:

contacting a rotating wheel of the roller skate with a rotatable member;

frictionally slowing the rotatable member such that heat energy created in slowing the rotatable member is substantially prevented from reaching the wheel.

23. A method as in claim 22, wherein the slowing step further comprises positioning a braking surface against the rotatable member after the rotatable member begins rotating.

24. A method as in claim 23, wherein the roller skate further comprises an elastomeric housing having the braking surface positioned therein, and wherein the housing is operably attached to the rotatable member so as to be spaced-apart from the braking surface, and wherein the positioning step comprises forcing the housing against the braking surface after the rotatable member contacts the wheel.

25. A method as in claim 24, further comprising moving a brake arm to position the braking surface against the rotatable member.

26. A method as in claim 25, further comprising rotating a cuff on the roller skate to move the brake arm.

27. A method as in claim 22, further comprising engaging the rotatable member with the rotating wheel without causing substantial jerking motion to the roller skate.

28. A method as in claim 22, further comprising maintaining the rotatable member spaced apart from the wheel of the skate until contacting the rotatable member with the rotating wheel.

29. A method as in claim 28, further comprising allowing the wheels to rotate at varying speeds when there is no braking action to facilitate turning of the skate.

* * * * *